US011027937B2

(12) United States Patent
Fukasawa et al.

(10) Patent No.: US 11,027,937 B2
(45) Date of Patent: Jun. 8, 2021

(54) MOVING GATE FOR GUIDING PRINT MEDIA

(71) Applicant: Hewlett-Packard Development Company, L.P., Spring, TX (US)

(72) Inventors: Eiji Fukasawa, Suwon-si (KR); Tae Hong Kim, Suwon-si (KR); Dong Sun Jung, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 84 days.

(21) Appl. No.: 16/430,771

(22) Filed: Jun. 4, 2019

(65) Prior Publication Data

US 2019/0284004 A1 Sep. 19, 2019

Related U.S. Application Data

(63) Continuation of application No. PCT/KR2017/014529, filed on Dec. 12, 2017.

(30) Foreign Application Priority Data

Dec. 12, 2016 (KR) ..... 10-2016-0168718

(51) Int. Cl.
*B65H 29/34* (2006.01)
*B65H 31/26* (2006.01)
(Continued)

(52) U.S. Cl.
CPC ..... *B65H 29/52* (2013.01); *B65H 29/12* (2013.01); *B65H 29/14* (2013.01); *B65H 29/34* (2013.01);
(Continued)

(58) Field of Classification Search
CPC .. B65H 31/26; B65H 29/34; B65H 2404/693; B65H 2404/68; B65H 29/52;
(Continued)

(56) References Cited

U.S. PATENT DOCUMENTS 5,609,333 A 3/1997 Mandel et al.
7,007,948 B2 * 3/2006 Kamiya ..... B65H 31/26 270/58.12

(Continued)

FOREIGN PATENT DOCUMENTS

JP 2005-015150 A 1/2005

*Primary Examiner* — Luis A Gonzalez
(74) *Attorney, Agent, or Firm* — Jefferson IP Law, LLP

(57) ABSTRACT

An example print medium loading device includes a loading unit on which a print medium is loadable, a transporting roller unit to transport a print medium toward the loading unit, and a moving gate between the loading unit and the transporting roller unit. The loading gate moves according to locations to which the print medium is transported. In an example, when a first print medium is loaded on the loading unit and the transporting roller unit transports a second print medium toward the loading unit, the moving gate is positioned at the first location to overlap a trailing end of the first print medium toward the moving gate. When the leading end of the second print medium is past the moving gate and the second print medium is loaded on the loading unit, the moving gate sequentially moves through the first through fourth positions.

18 Claims, 34 Drawing Sheets

(51) Int. Cl.

| | |
|---|---|
| ***B65H 29/52*** | (2006.01) |
| ***B65H 29/12*** | (2006.01) |
| ***B65H 29/60*** | (2006.01) |
| ***B65H 31/02*** | (2006.01) |
| ***B65H 29/14*** | (2006.01) |

(52) U.S. Cl.
CPC ..... *B65H 29/60* (2013.01); *B65H 31/02* (2013.01); *B65H 31/26* (2013.01); *B65H 2301/4213* (2013.01); *B65H 2301/42146* (2013.01); *B65H 2301/4435* (2013.01); *B65H 2404/61* (2013.01); *B65H 2404/63* (2013.01); *B65H 2404/68* (2013.01); *B65H 2404/693* (2013.01); *B65H 2701/1313* (2013.01); *B65H 2801/27* (2013.01)

(58) Field of Classification Search
CPC ..... B65H 29/14; B65H 29/22; B65H 2701/1313; B65H 29/12; B65H 29/60; B65H 2301/4435; B65H 2801/27; B65H 31/36; B65H 31/34; B65H 31/02
See application file for complete search history.

(56) References Cited

U.S. PATENT DOCUMENTS

| | | | | |
|---|---|---|---|---|
| 7,185,887 | B2 | 3/2007 | Chung | |
| 8,899,579 | B2 * | 12/2014 | Gamo | G03G 15/6552 271/218 |
| 2003/0175108 | A1 | 9/2003 | Askins | |
| 2007/0252323 | A1 | 11/2007 | Mandel | |
| 2013/0270762 | A1 * | 10/2013 | Saito | B42C 1/12 270/58.08 |
| 2014/0300049 | A1 * | 10/2014 | Rademakers | B65H 7/20 271/228 |
| 2015/0239702 | A1 * | 8/2015 | Sugiyama | B65H 31/02 271/220 |
| 2016/0090262 | A1 * | 3/2016 | Wakayama | B65H 31/22 271/314 |
| 2017/0183186 | A1 * | 6/2017 | Hara | B65H 7/02 |
| 2018/0265322 | A1 * | 9/2018 | Deocon Mir | B65H 31/02 |

* cited by examiner

MOVING GATE FOR GUIDING PRINT MEDIA

CROSS-REFERENCE TO RELATED APPLICATIONS

This application is a continuation of International Application PCT/KR2017/014529 filed on Dec. 12, 2017, which claims the priority benefit of Korean Patent Application No. 10-2016-0168718, filed on Dec. 12, 2016. Both the International Application and the Korean Patent Application are incorporated by reference herein in their entirety.

BACKGROUND

A print medium finishing apparatus aligns print media on which images are formed by an image forming apparatus. The print medium finishing apparatus may perform post-processing such as hole-punching, bookbinding, etc. on the print media.

Such a print medium finishing apparatus includes a print medium loading device on which print media, with respect to which printing has been completed by the image forming apparatus, are loaded. The print medium loading device includes a transporting roller unit that transports a print medium, and a loading unit on which the transported print medium is loaded.

DESCRIPTION OF DRAWINGS

Various examples will be described below in conjunction with the accompanying drawings in which.

DETAILED DESCRIPTION OF EXAMPLES

Figure 1:
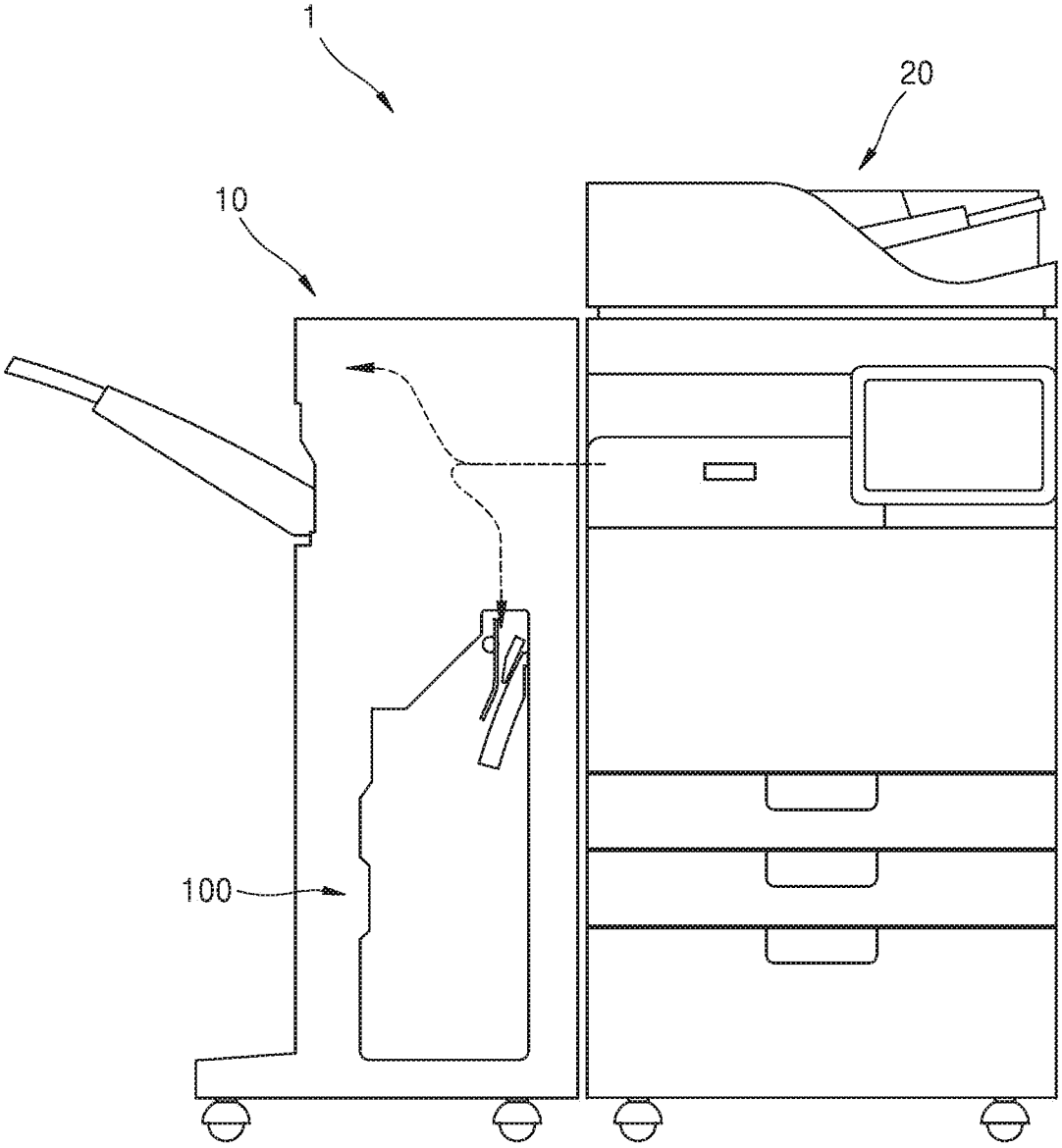
FIG. 1 is a front view of an image forming system according to an example.

Hereinafter, features and effects of examples of the disclosure will be described more fully with reference to the accompanying drawings, in which examples of the disclosure are shown.

Terms used herein will be described briefly, and examples of the present disclosure will be described in more detail.

Although general terms presently used were selected for describing examples of the present disclosure in consideration of the functions thereof, these general terms may vary according to intentions of one of ordinary skill in the art, case precedents, the advent of new technologies, or the like. Terms arbitrarily selected by the applicant may also be used in a specific case. In this case, their meanings need to be given in the description of the disclosure. Hence, the terms must be defined based on their meanings and the contents of the entire specification, not by simply stating the terms.

The terms "comprises" and/or "comprising" or "includes" and/or "including" when used in this specification, specify the presence of stated elements, but do not preclude the presence or addition of one or more other elements.

It will be understood that although the terms "first," "second," etc. may be used herein to describe various components, these components should not be limited by these terms. These components are only used to distinguish one component from another.

Examples of the present disclosure will now be described more fully with reference to the accompanying drawings, in which examples of the disclosure are shown. The disclosure may, however, be embodied in many different forms and should not be construed as being limited to the examples set forth herein. In the drawings, parts irrelevant to the description are omitted for simplicity of explanation, and like numbers refer to like elements throughout.

FIG. 1 is a front view of an image forming system according to an example.

Referring to FIG. 1, an image forming system 1 includes an image forming apparatus 20 and a print medium finishing apparatus 10. The image forming apparatus 20 forms an image on at least one surface of a print medium. The print medium on which an image has been formed by the image forming apparatus 20 is transmitted to the print medium finishing apparatus 10.

The print medium finishing apparatus 10 aligns and loads a plurality of print media on which images have been formed by the image forming apparatus 20.

The print medium finishing apparatus 10 includes a print medium loading device 100 that loads the plurality of print media. In the print medium loading device 100, the plurality of print media may be aligned in order, and a stapling operation, a hole punch operation, or the like may be conducted on the print media.

As shown in FIG. 1, the print medium finishing apparatus 10 may be, but is not limited to, an independent component that is separate from the image forming apparatus 20. For example, although not shown, the print medium finishing apparatus 10 may be disposed abutting or connected to the image forming apparatus 20 to serve as a component of the image forming apparatus 20.

Figure 2A:
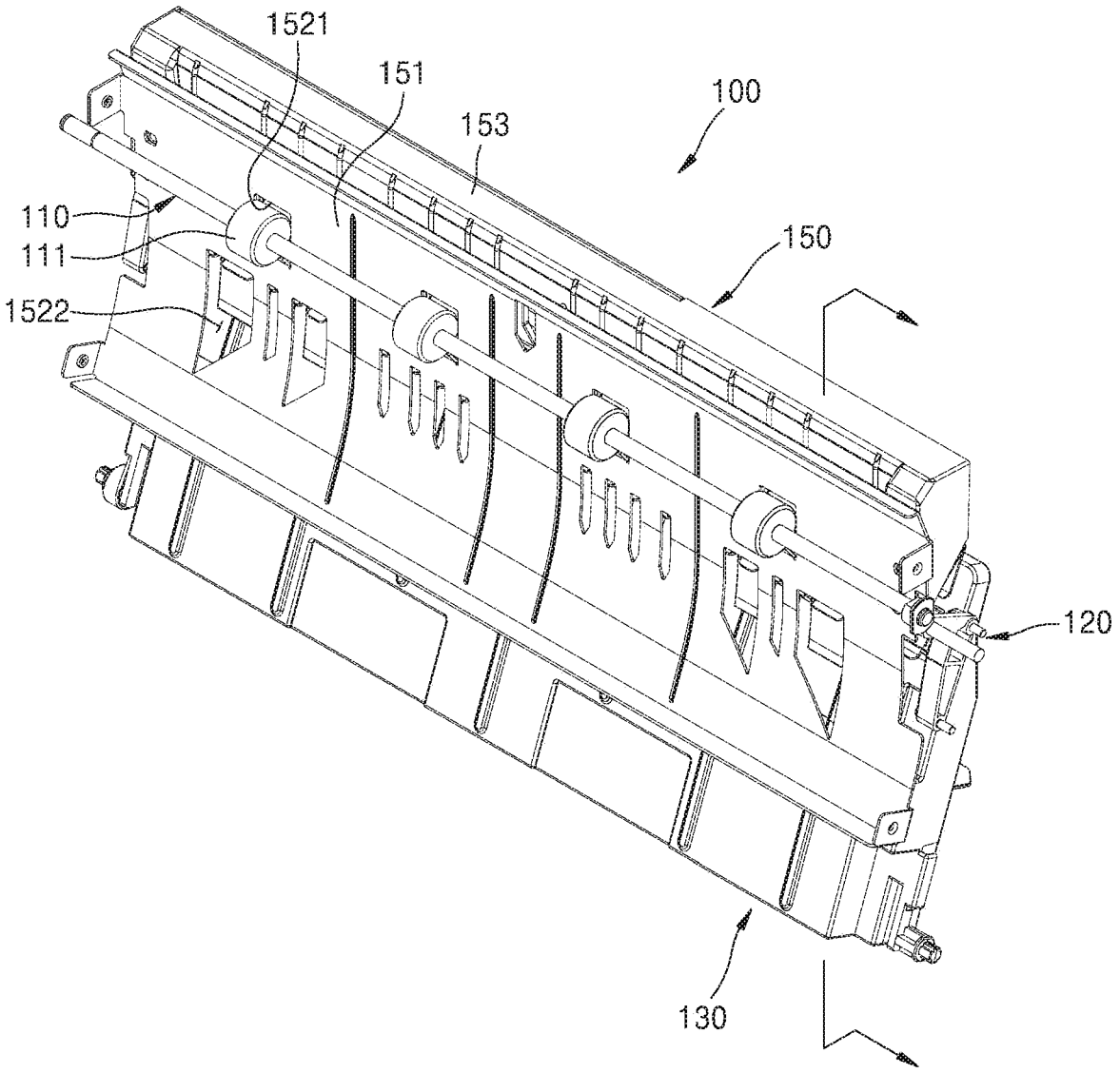
FIG. 2A is a perspective view for explaining components of a print medium loading device according to an example.
Figure 2B:
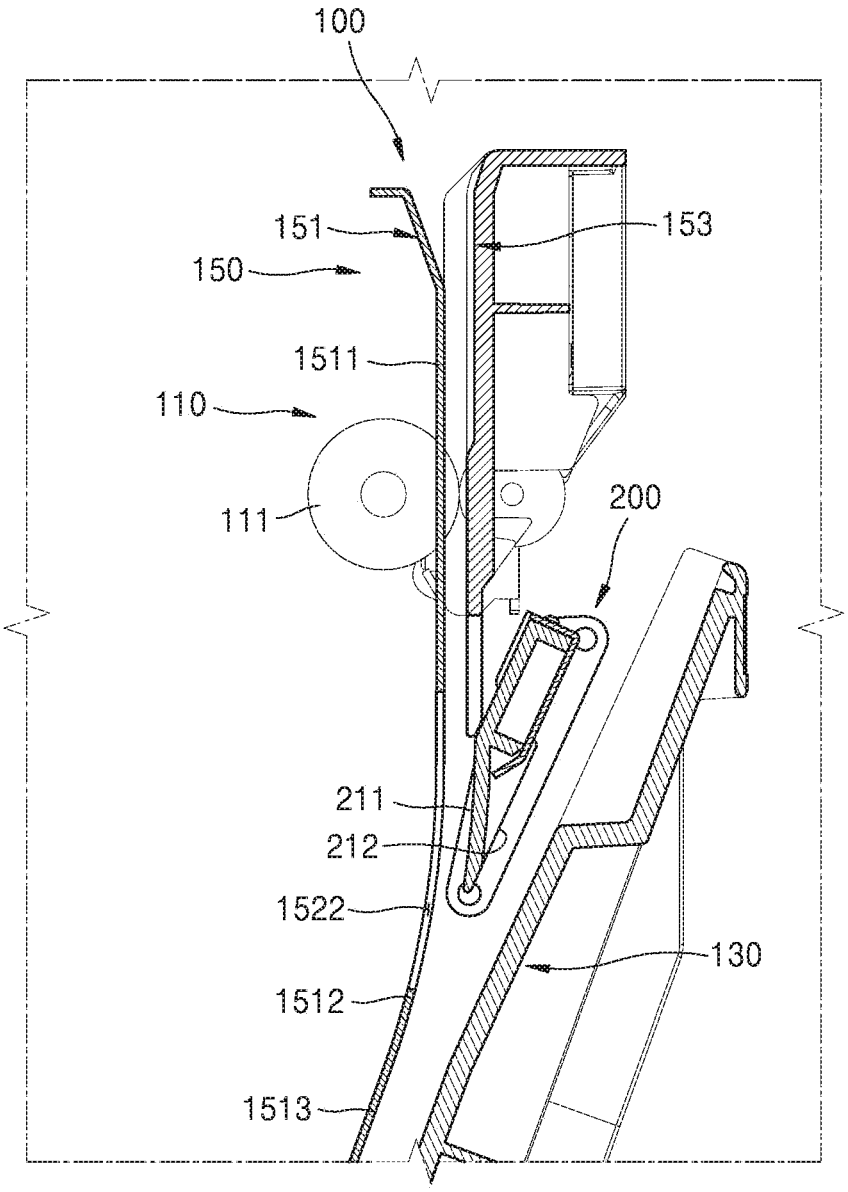
FIG. 2B is a cross-sectional view of the print medium loading device of FIG. 2A according to an example.

FIG. 2A is a perspective view for explaining components of a print medium loading device according to an example, and FIG. 2B is a cross-sectional view of the print medium loading device of FIG. 2A according to an example.

Referring to FIGS. 2A and 2B, the print medium loading device 100 may include a transporting roller unit 110, a loading unit 130, and a moving gate 200. The print medium loading device 100 may further includes a print medium guide 150.

The print medium guide 150 may guide a print medium such that a leading end of the print medium is directed toward the transporting roller unit 110, and may guide the print medium passed through the transporting roller unit 110 such that the leading end of the print medium is directed toward the loading unit 130.

The print medium guide 150 includes an upper surface guide 151 that guides an upper surface of the print medium, and a lower surface guide 153 that guides a lower surface of the print medium. The lower surface guide 153 is disposed to face a portion of the upper surface guide 151.

The upper surface guide 151 includes first openings 1521 into which the transporting roller unit 110 is insertable, and second openings 1522 into which a portion of the moving gate 200 is insertable.

The upper surface guide 151 includes a first region 1511 extending in a first direction, a second region 1513 extending in a second direction that makes an acute angle with the first direction, and a curved region 1512 connecting the first region 1511 to the second region 1513. The first direction may be the direction of gravity. The lower surface guide 153 is disposed to face the first region 1511.

The transporting roller unit 110 is disposed on the print medium guide 150. For example, the transporting roller unit 110 may be disposed on the first region 1511 of the upper surface guide 151.

The transporting roller unit 110 includes a plurality of rollers 111 spaced apart from each other in a width direction of a print medium. The plurality of rollers 111 may be inserted into the first openings 1521 formed in the first region 1511.

As the plurality of rollers 111 rotate, print media are transported in order along a transport path.

The print media transported by the transporting roller unit 110 are loaded on the loading unit 130. The loading unit 130 is disposed below the transporting roller unit 110. The loading unit 130 may be disposed at an angle to the direction of gravity. The loading unit 130 may be parallel to the second region 1513.

The print media transported in order by the transporting roller unit 110 may be loaded in the order in which the print media are transported. For example, a later-transported print medium may be loaded on a print medium transported earlier and loaded on the loading unit 130.

However, while a print medium is being transported and loaded on the loading unit 130, the print medium may be bent. In this case, the print media may not be loaded in the order in which they are transported.

For example, a trailing end of a print medium may be above and not in contact with the loading unit 130. When another print medium is transported while the trailing end of the print medium loaded on the loading unit 130 floats above it, a leading end of the other print medium may be inserted between the previous print medium and the loading unit 130. In this case, a paper alignment error in which the order of the print media is changed occurs.

To address this paper alignment error, the print medium loading device 100 includes the moving gate 200, which is disposed between the transporting roller unit 110 and the loading unit 130 and moves according to locations to which a print medium is transported.

When print media are transported by the transporting roller unit 110, the moving gate 200 may reduce or block contact between a trailing end of a print medium earlier transported and loaded on the loading unit 130 (hereinafter, referred to as a first print medium) and a leading end of a print medium later transported by the transporting roller unit 110 (hereinafter, referred to as a second print medium).

When the second print medium is loaded on the loading unit 130, the moving gate 200 may contact (e.g., press) a trailing end of the second print medium loaded on the loading unit 130 in a direction closer to the loading unit 130. Accordingly, a print medium transported after the second print medium is transported (hereinafter, referred to as a third print medium) may avoid contact with the trailing ends of the first and second print media. This may assist with sequential loading of the plurality of print media.

The moving gate 200 may be a single component that performs different functions according to different locations. For example, the moving gate 200 may include a first side 211 that guides the second print medium, and a second side 212 opposite to the first side 211. When the moving gate 200 is at a certain location, the first side 211 guides a movement of the leading end of the second print medium transported by the transporting roller unit 110. While the moving gate 200 is moving, the second side 212 presses the trailing end of the second print medium loaded on the loading unit 130.

The moving gate 200 may be a single component that moves as a unit. In other words, the moving gate 200 may not include a plurality of components of which respective movements are linked with each other. Accordingly, the moving gate 200 may not have a complicated linkage structure required by a plurality of components of which respective movements are linked with each other, and does not perform a complicated control operation for a complicated linkage structure. Therefore, the moving gate 200 and the print medium loading device 100 including the same have relatively simple structures and thus may be manufactured at low costs.

FIGS. 3A-3G are cross-sectional views for explaining a print medium loading device according to an example.

Figure 3A:
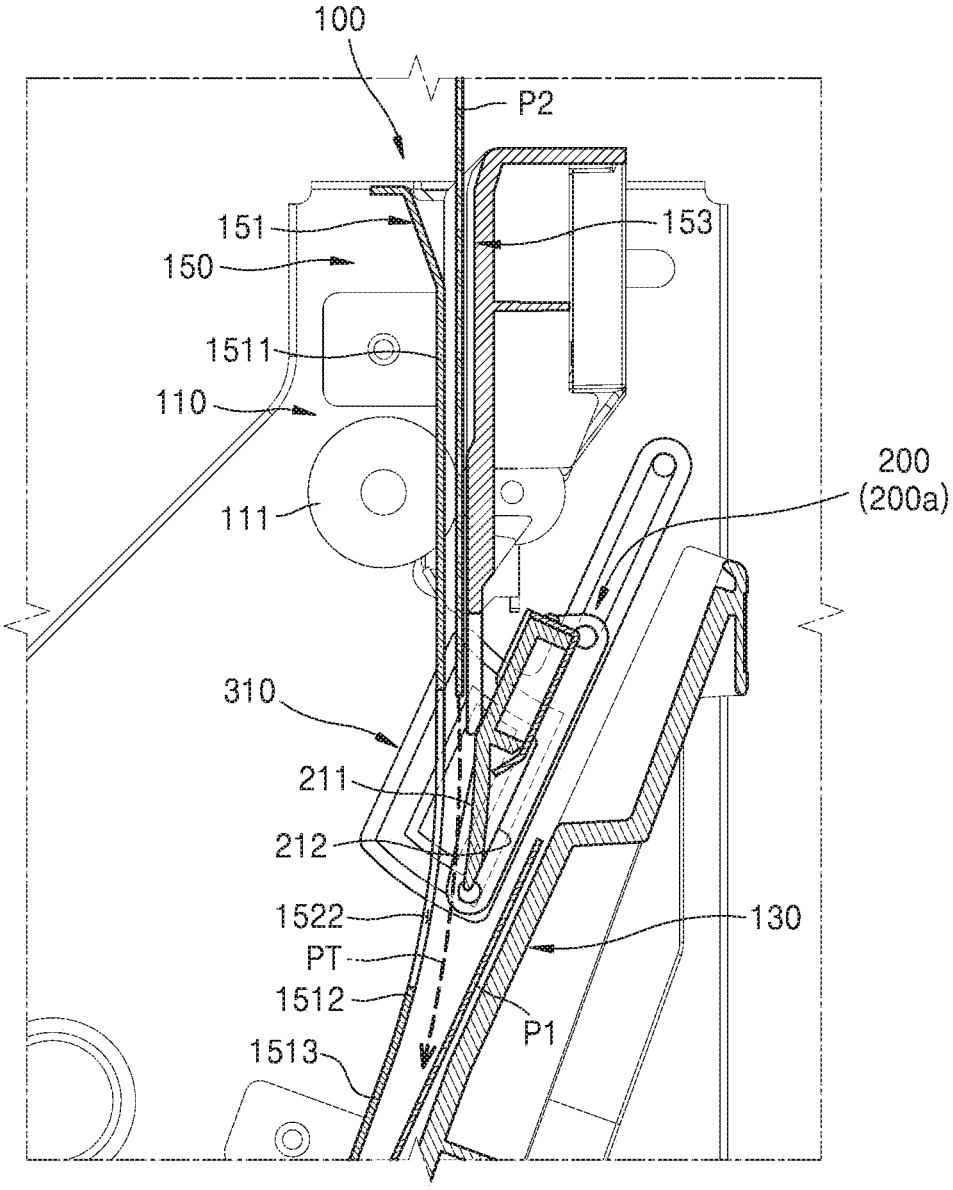
FIGS. 3A-3G are cross-sectional views for explaining a print medium loading device according to an example.

Referring to FIG. 3A, when a first print medium P1 is loaded on the loading unit 130, a second print medium P2 is transported toward the loading unit 130 by the transporting roller unit 110. When the second print medium P2 is transported by the transporting roller unit 110, the moving gate 200 is positioned at a first location 200*a*.

When the moving gate 200 is at the first location 200*a*, the moving gate 200 is overlapped by a trailing end of the first print medium P1 and is between the first print medium P1 and the second print medium P2. The first side 211 of the moving gate 200 is directed toward the second print medium P2 and the second side 212 thereof is directed toward the first print medium P1. A certain space or gap exists between the moving gate 200 and the loading unit 130. For example, a space or gap that is greater than a sum of thicknesses of the print media may exist between the moving gate 200 and the loading unit 130.

Because the moving gate 200 overlaps the trailing end of the first print medium P1, the moving gate 200 may reduce or block contact between a leading end of the second print medium P2 and the trailing end of the first print medium P1. At this time, the moving gate 200 may guide movement of the second print medium P2 via the first side 211.

Figure 3B:
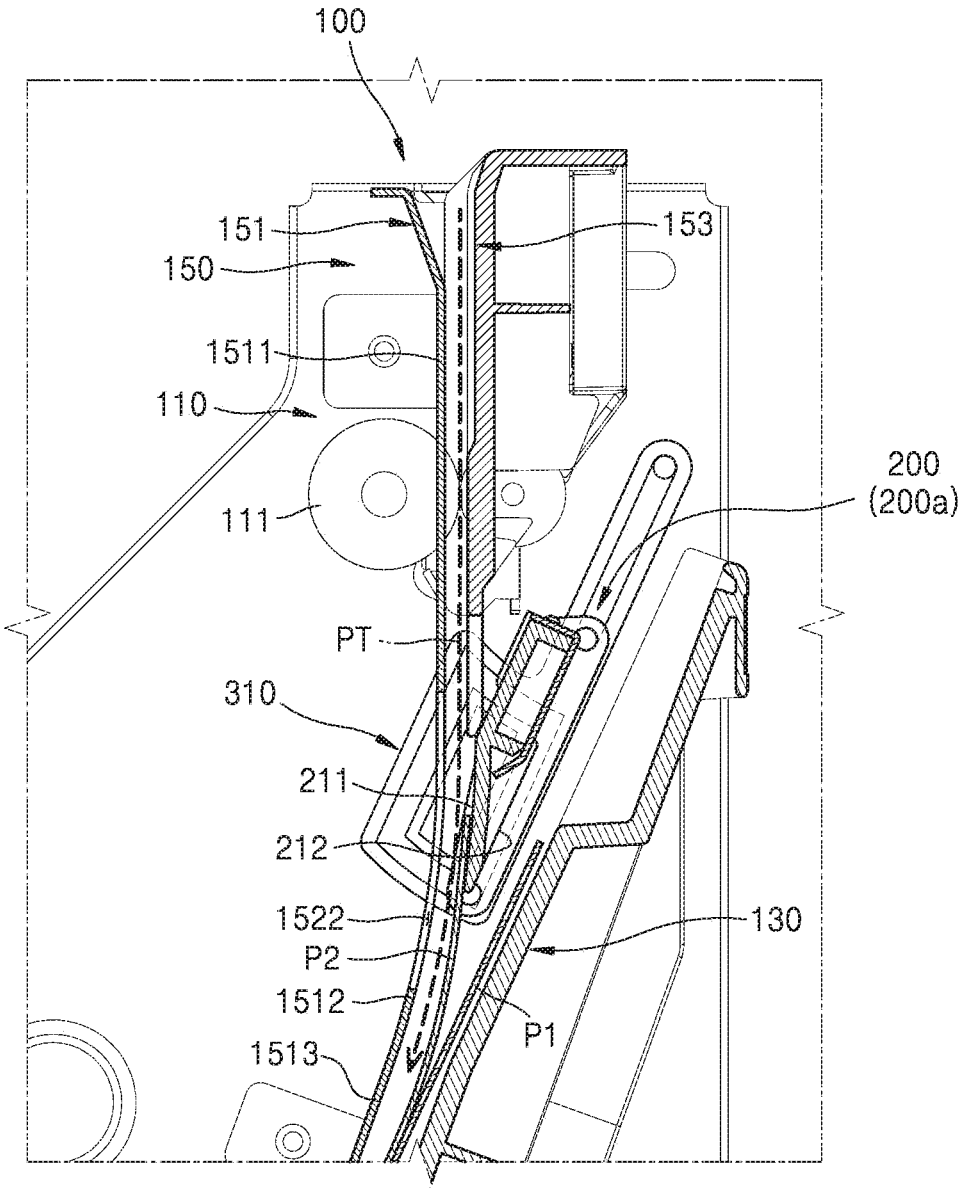

Referring to FIG. 3B, the leading end of the second print medium P2 passes by the moving gate 200, and the second print medium P2 is loaded on the loading unit 130. When the leading end of the second print medium P2 moves to the same location as the leading end of the first print medium P1 and the second print medium P2 is loaded on the loading unit 130, the trailing end of the second print medium P2 overlaps the moving gate 200. At this time, the moving gate 200 is between the trailing end of the second print medium P2 and the trailing end of the first print medium P1.

Figure 3C:
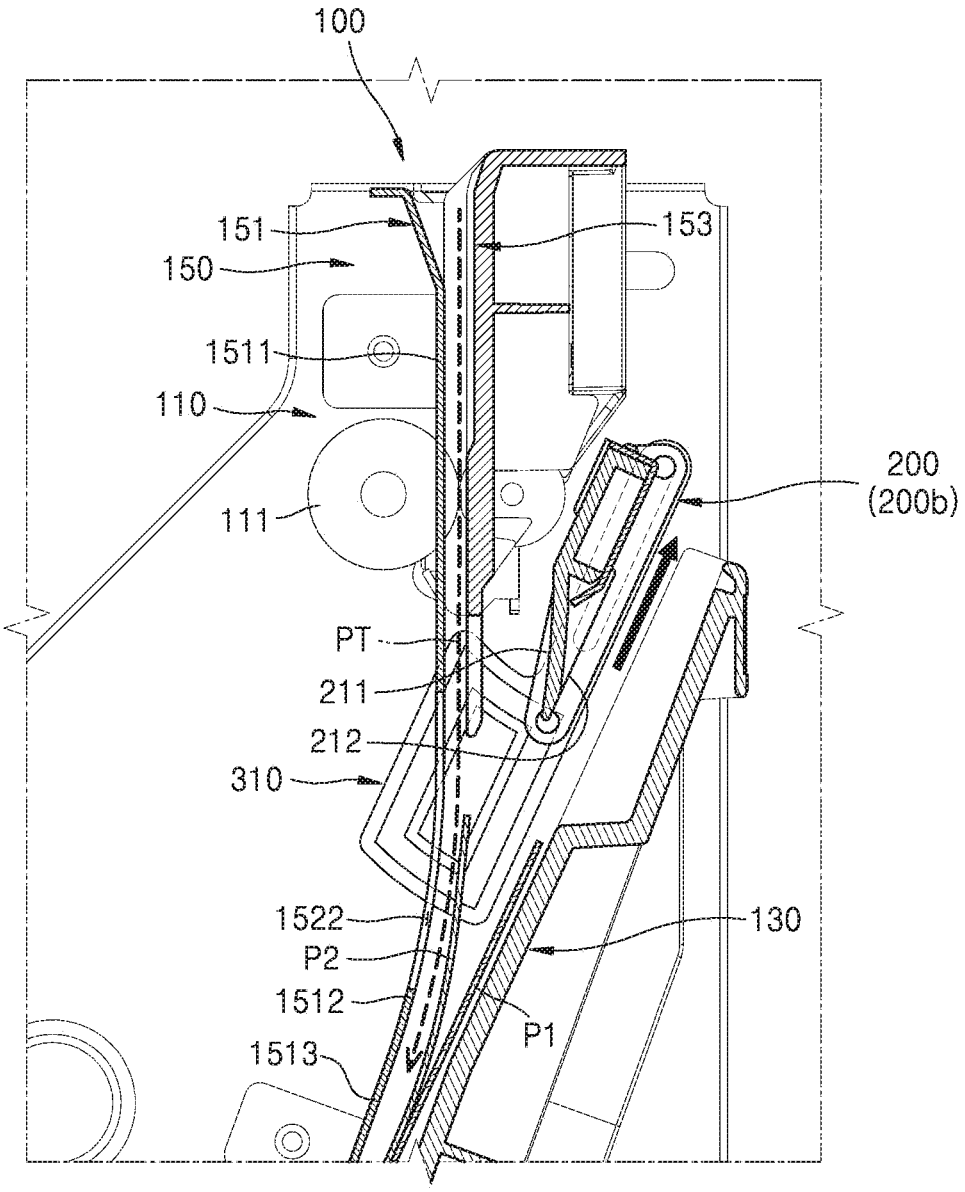

Referring to FIG. 3C, the moving gate 200 moves from the first location 200*a* to a second location 200*b*. When the moving gate 200 is at the second location 200*b*, the moving gate 200 is spaced apart from the first print medium P1 and the second print medium P2. In other words, the moving gate 200 deviates from the space between the first print medium P1 and the second print medium P2. Accordingly, the trailing end of the second print medium P2 and the trailing end of the first print medium P1 face each other.

However, the second print medium P2 may have been bent due to various causes, such as an internal temperature, friction, and the like of the print medium finishing apparatus 10. In this case, the trailing end of the second print medium P2 may be spaced apart from the trailing end of the first print medium P1 without being adhered thereto (i.e., without abutting the first print medium P1).

For example, when the moving gate 200 moves from the first location 200*a* to the second location 200*b*, the moving gate 200 may move parallel to a layout direction of the loading unit 130. Accordingly, when the moving gate 200 moves from the first location 200*a* to the second location 200*b*, a space or gap between the moving gate 200 and the loading unit 130 may be maintained constant. The space or gap between the moving gate 200 and the loading unit 130 is defined as a space or gap in a direction perpendicular to the layout direction of the loading unit 130.

As another example, when the moving gate 200 moves from the first location 200*a* to the second location 200*b*, the moving gate 200 may move in a direction that makes an acute angle with the layout direction of the loading unit 130, so as to be away from the loading unit 130. Accordingly, when the moving gate 200 moves from the first location 200*a* to the second location 200*b*, the space or gap between the moving gate 200 and the loading unit 130 may increase.

As such, because a space or gap exists between the moving gate 200 and the loading unit 130, while the moving gate 200 is moving to the second location 200*b*, the moving gate 200 may not contact the first print medium P1, or may not press the first print medium P1 even when contacting the first print medium P1. Accordingly, while the moving gate 200 is moving to the second location 200*b*, the moving gate 200 may prevent misalignment or damage of the first print medium P1.

When the moving gate 200 is at the first location 200*a*, even when the second print medium P2 and the moving gate 200 contact each other, a force other than gravity is not applied between the second print medium P2 and the moving gate 200, and thus, while the moving gate 200 is moving to the second location 200*b*, the moving gate 200 may not press a lower surface of the second print medium P2 and may not damage the second print medium P2.

Figure 3D:
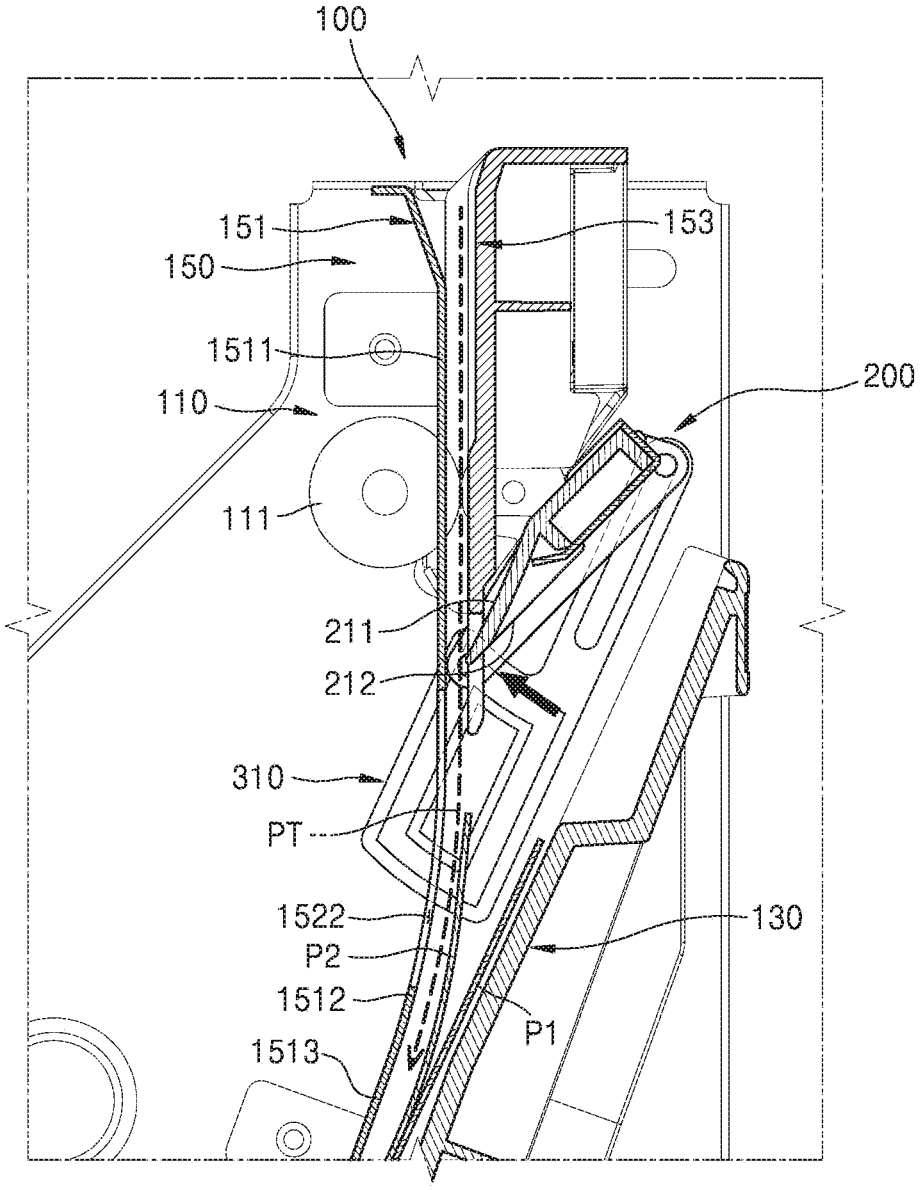
Figure 3E:
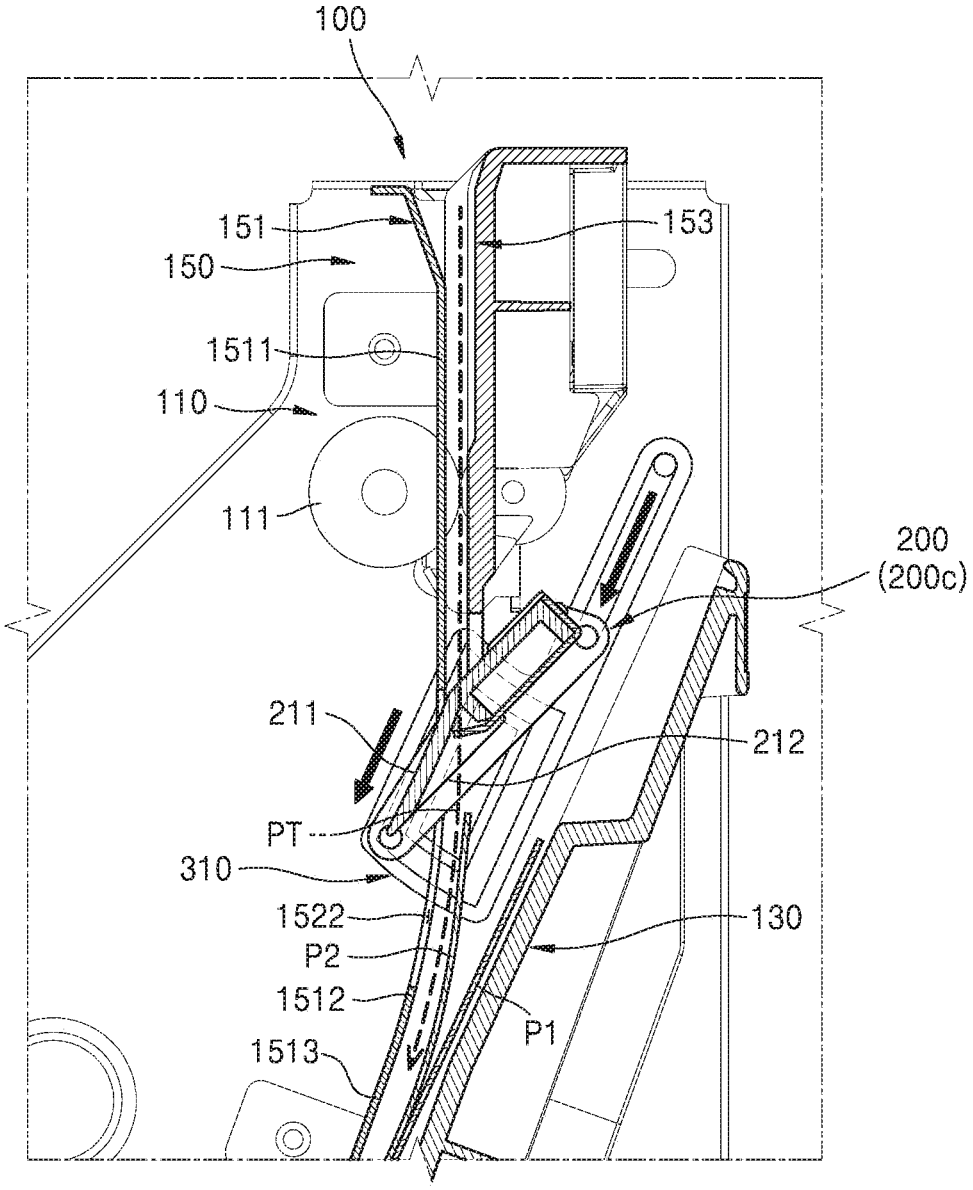

Referring to FIGS. 3D and 3E, the moving gate 200 moves from the second location 200*b* to a third location 200*c*. While the moving gate 200 is moving from the second location 200*b* to the third location 200*c*, the moving gate 200 may not bump into the trailing end of the second print medium P2.

For example, as shown in FIG. 3D, the moving gate 200 moves such that a leading end thereof is directed toward a transport path PT of the second print medium P2. The transport path PT of the second print medium P2 refers to a virtual path in which the leading end of the second print medium P2 moves. Thereafter, as shown in FIG. 3E, the moving gate 200 may move in a direction closer to the second print medium P2. When the moving gate 200 moves from the second location 200*b* to the third location 200*c*, the leading end of the moving gate 200 may be inserted into the second openings 1522 of the print medium guide 150.

Referring to FIG. 3E, when the moving gate 200 is at the third location 200*c*, the moving gate 200 may be positioned over the transport path PT of the second print medium P2 and may overlap the trailing end of the second print medium P2. The leading end of the moving gate 200 may protrude from the second openings 1522.

Figure 3F:
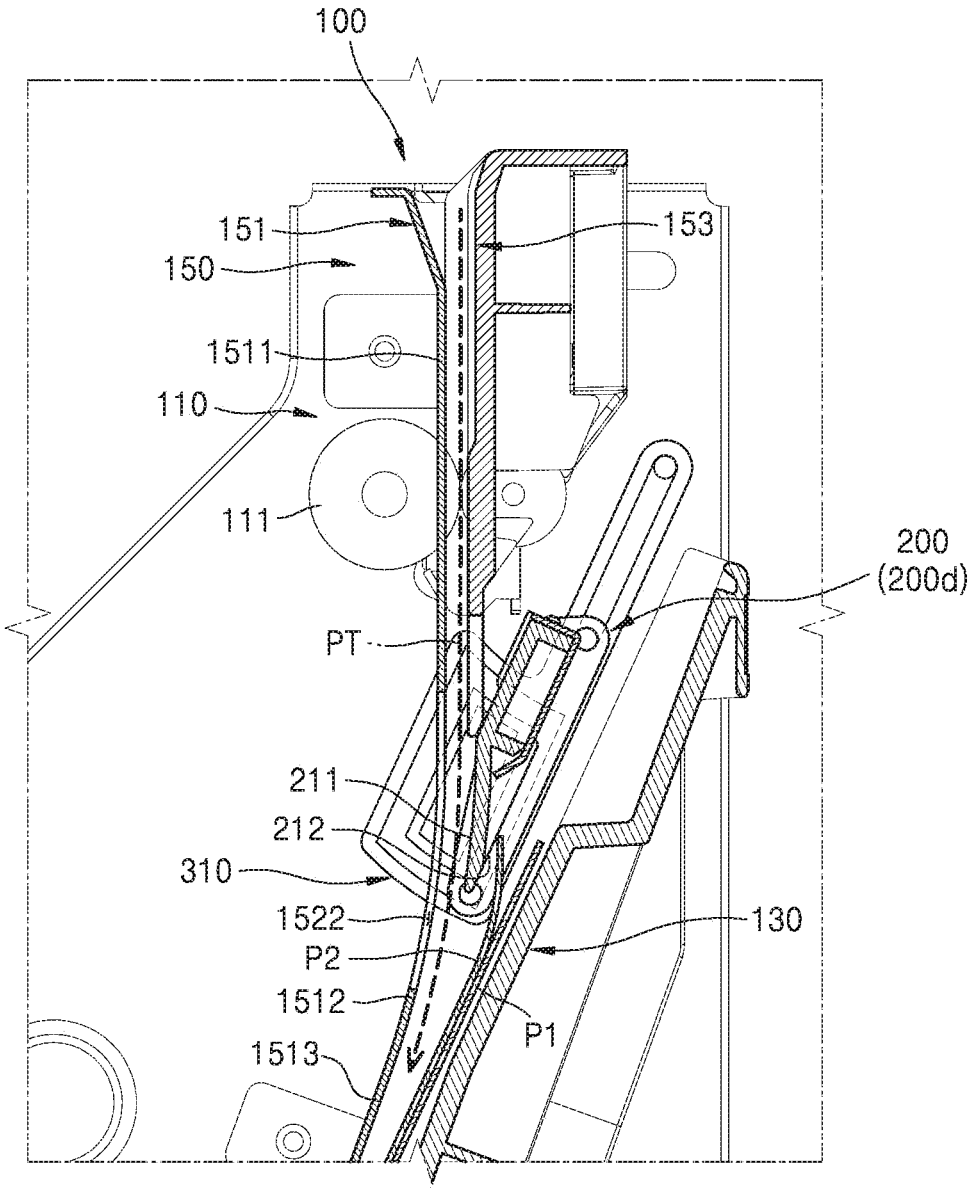

Referring to FIG. 3F, the moving gate 200 may move from the third location 200*c* to a fourth location 200*d*. When the moving gate 200 is at the fourth location 200*d*, the moving gate 200 is disposed closer to the second print medium P2 than when the moving gate 200 is at the third location 200*c*. When the second print medium P2 is in a bent state and the moving gate 200 is at the fourth location 200*d*, the moving gate 200 may contact the trailing end of the second print medium P2.

When the moving gate 200 moves from the third location 200*c* to the fourth location 200*d*, the moving gate 200 may press the trailing end of the second print medium P2 loaded on the loading unit 130 toward the loading unit 130. During this process, the leading end of the moving gate 200 passes through the second openings 1522 of the print medium guide 150 from the outside to the inside. When the moving gate 200 is at the fourth location 200*d*, the moving gate 200 may be over the first print medium P1 and the second print medium P2 and may overlap the trailing ends of the first and second print media P1 and P2.

Figure 3G:
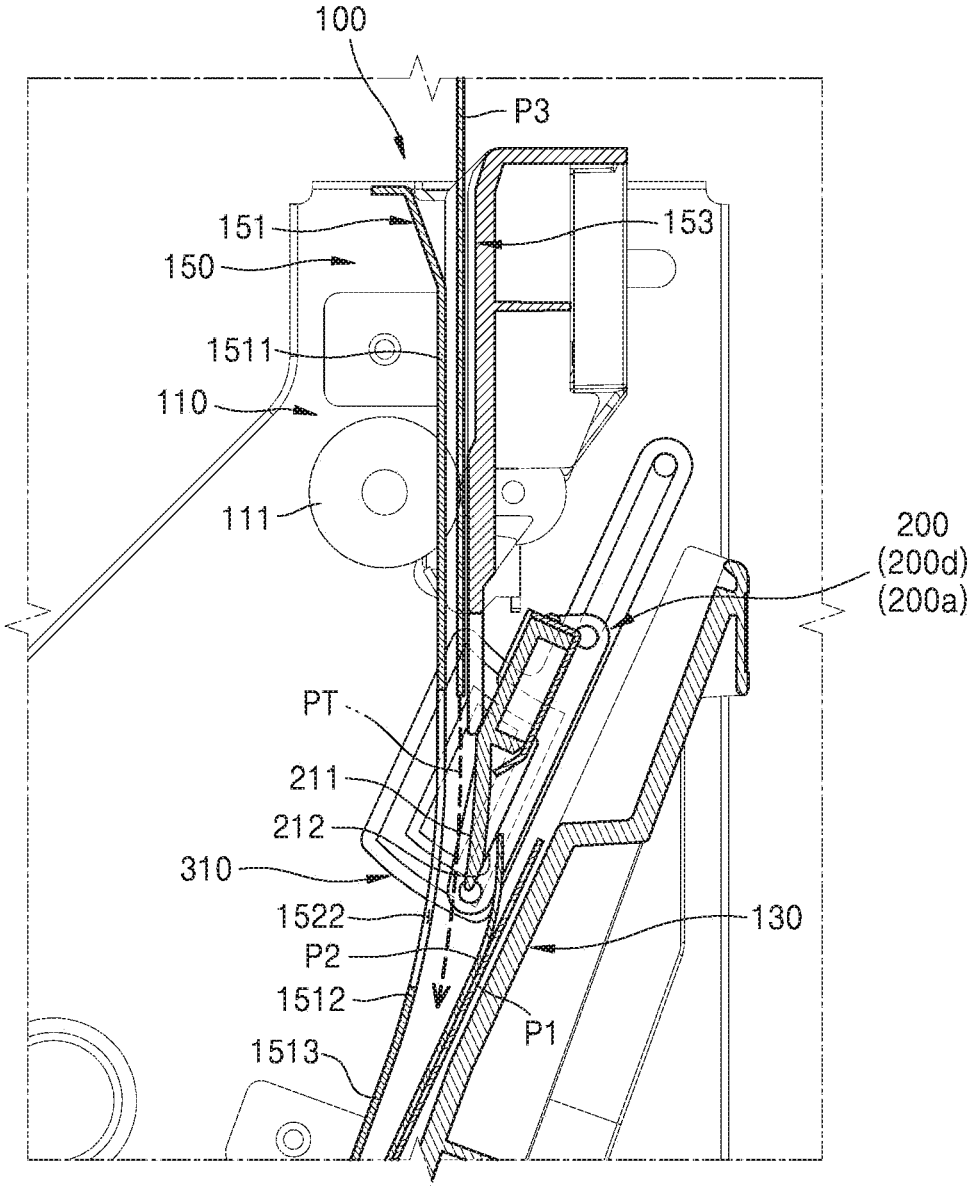

However, when the second print medium P2 is in a non-bent state and the moving gate 200 is at the fourth location 200*d*, the moving gate 200 may not contact the trailing end of the second print medium P2. Referring to FIG. 3G, when the moving gate 200 is at the fourth location 200*d*, a third print medium P3 is transported by the transporting roller unit 110. The fourth location 200*d* of the moving gate 200 may be the same as the first location 200*a*.

The moving gate 200 overlaps the trailing ends of the first and second print media P1 and P2 and is between the second print medium P2 and the third print medium P3. At this time, the first side 211 of the moving gate 200 is directed toward the third print medium P3 and the second side 212 thereof is directed toward the second print medium P2.

Because the moving gate 200 overlaps the trailing ends of the first and second print media P1 and P2, the moving gate 200 may reduce or block contact between a leading end of the third print medium P3 and the trailing ends of the first and second print media P1 and P2.

As such, as the moving gate 200 sequentially moves from the first location 200*a* to the fourth location 200*d*, a plurality of print media, namely, the first, second, and third media P1, P2, and P3, may be sequentially loaded on the loading unit 130.

Figure 4:
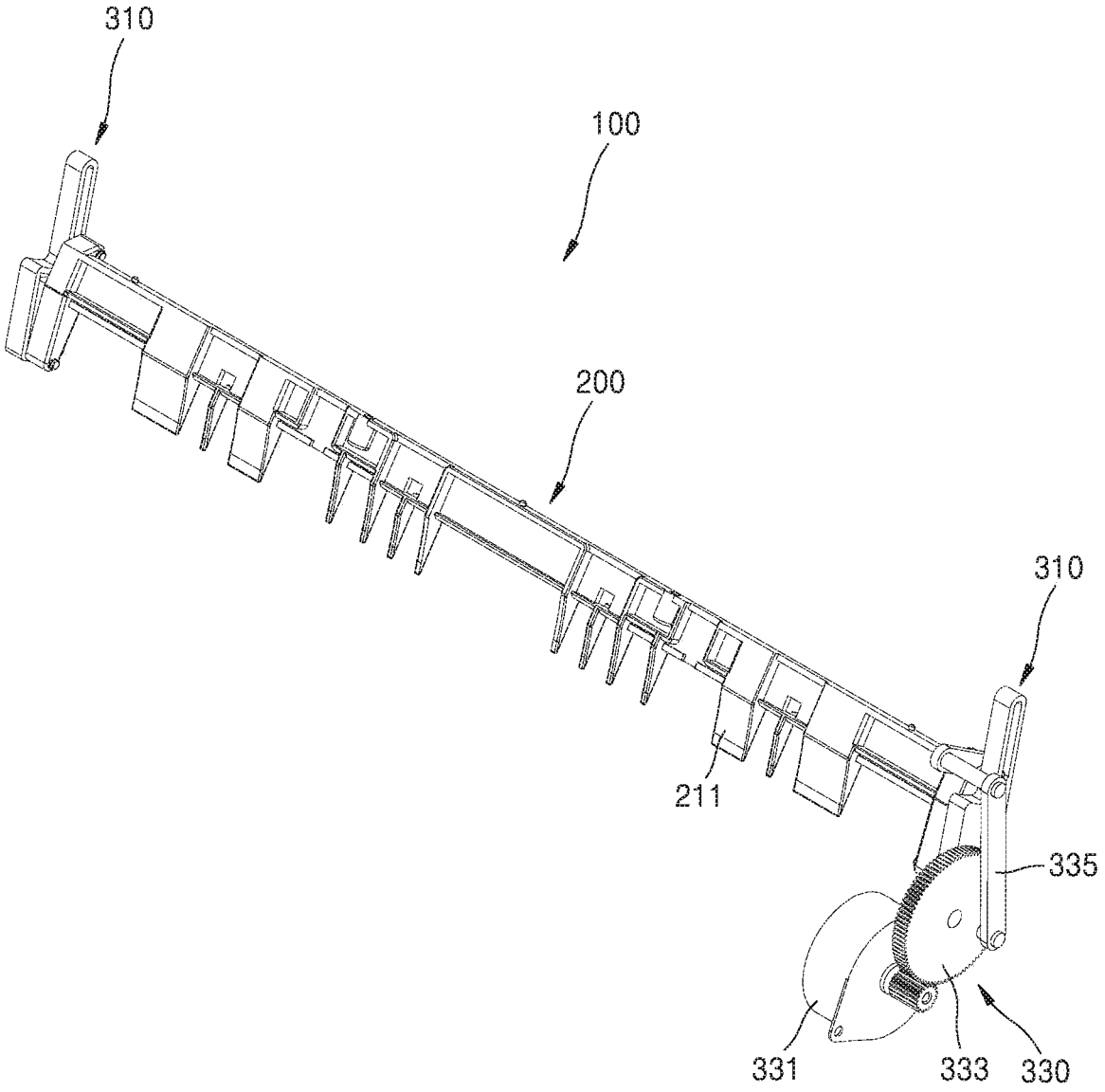
FIG. 4 is a perspective view of a print medium loading device including a structure for moving a moving gate of FIGS. 3A-3G according to an example.
Figure 5A:
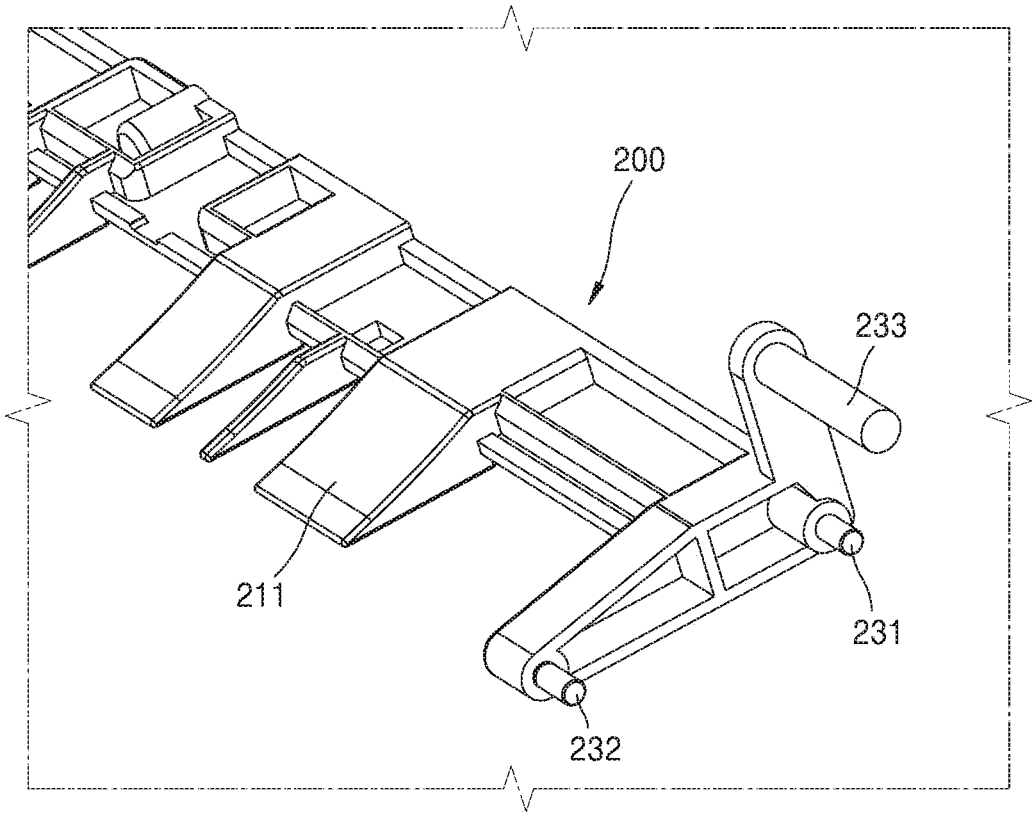
FIG. 5A is a magnified perspective view of one end of the moving gate of FIG. 4 according to an example.
Figure 5B:
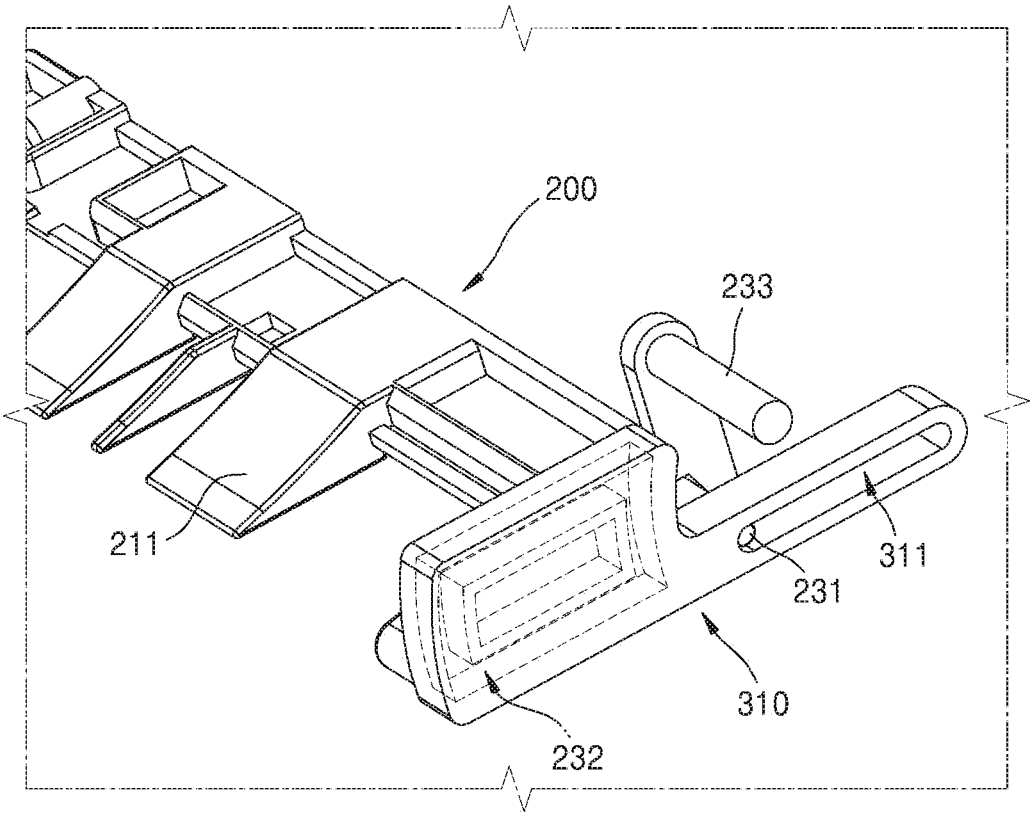
FIG. 5B is a magnified perspective view for explaining a guide structure arranged on one end of the moving gate according to an example.
Figure 5C:
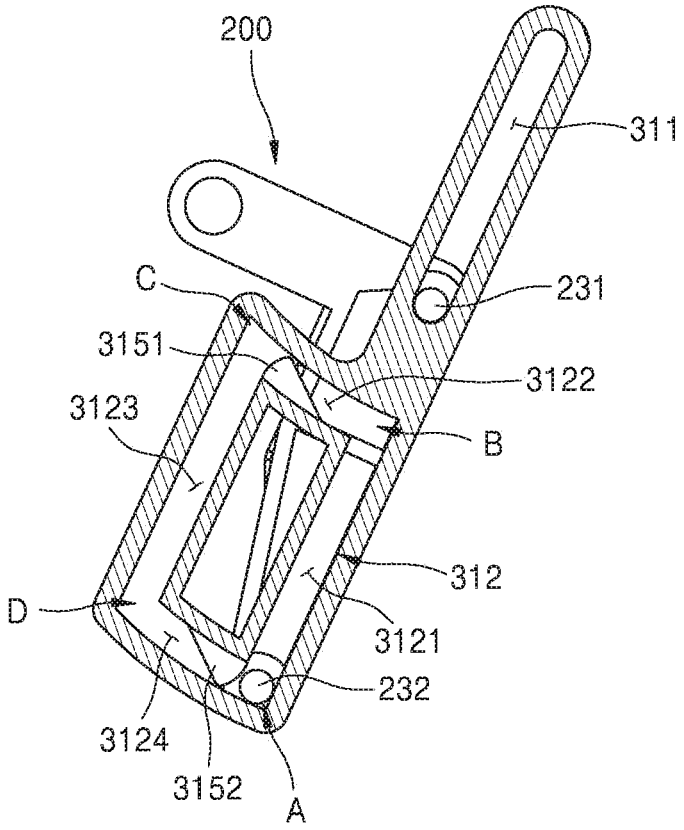
FIG. 5C is a view illustrating a cross section of FIG. 5B according to an example.

FIG. 4 is a perspective view of a print medium loading device including a structure for moving a moving gate of FIGS. 3A-3G according to an example. FIG. 5A is a magnified perspective view of one end of the moving gate of FIG. 4 according to an example. FIG. 5B is a magnified perspective view for explaining a guide structure arranged on the one end of the moving gate according to an example. FIG. 5C is a view illustrating a cross section of FIG. 5B according to an example. FIGS. 6A-6E are cross-sectional views for explaining an operation of the print medium loading device of FIG. 4 according to an example. For convenience of explanation, FIGS. 4-6E omit illustration of the transporting roller unit 110 and the loading unit 130.

Referring to FIG. 4, the print medium loading device 100 further includes guide structures 310, and a power transmit unit 330 which transmits a driving force to the moving gate 200. The guide structures 310 guide movement of the moving gate 200 such that the moving gate 200 sequentially repeats the first location 200*a*, the second location 200*b*, the third location 200*c*, and the fourth location 200*d*.

The guide structures 310 are respectively disposed on both ends of the moving gate 200 in a direction perpendicular to a movement direction of the moving gate 200.

The power transmit unit 330 includes a motor 331 which is connected to at least one of the guide structures 310 respectively disposed on both ends of the moving gate 200 and generates a driving force, a crank wheel 333 which rotates with rotation of the motor 331, and a connection link 335 which switches a rotation of the crank wheel 333 to a reciprocating motion thereof. One end of the connection link 335 is pivotably connected to the moving gate 200 and the other end thereof is pivotably connected to the crank wheel 333.

Referring to FIGS. 5A-5C, a first protrusion 231 and a second protrusion 232, each extending in a direction perpendicular to the movement direction of the moving gate 200, are formed on either end of the moving gate 200. The first protrusion 231 and the second protrusion 232 are spaced apart from each other. A third protrusion 233 that pivotably supports the connection link 335 is formed on at least one of both ends of the moving gate 200.

The guide structures 310 are respectively disposed on both ends of the moving gate 200 in order to guide movements of the first protrusion 231 and the second protrusion 232.

Each of the guide structures 310 includes a first guide rail 311 which guides the movement of the first protrusion 231, and a second guide rail 312 which guides the movement of the second protrusion 232. The first guide rail 311 guides a reciprocating motion of the first protrusion 231. The second guide rail 312 guides a circular motion of the second protrusion 232. The second protrusion 232 may move in a circular motion counterclockwise along the second guide rail 312.

The first guide rail 311 may extend to have a straight line shape. A width of the first guide rail 311 may correspond to a dimension (e.g., a height or a diameter) of the first protrusion 231.

The second guide rail 312 includes a first section 3121 extending in a same direction as a direction in which the first guide rail 311 extends, a second section 3122 extending in a direction intersecting with the extending direction of the first section 3121, a third section 3123 extending to intersect with the second section 3122, and a fourth section 3124 extending to intersect with the third section 3123. A point where the fourth section 3124 and the first section 3121 are connected to each other is referred to as a point A, a point where the first section 3121 and the second section 3122 are connected to each other is referred to as a point B, a point where the second section 3122 and the third section 3123 are connected to each other is referred to as a point C, and a point where the third section 3123 and the fourth section 3124 are connected to each other is referred to as a point D.

The first section 3121 and the third section 3123 may be parallel to each other. The extending direction of the first section 3121 may be the same as the extending direction of the first guide rail 311. A width of each of the first section 3121, the second section 3122, the third section 3123, and the fourth section 3124 may correspond to a dimension (e.g., a height or a diameter) of the second protrusion 232.

A length of the first guide rail 311 may be equal to that of the first section 3121. The length of the first guide rail 311 may be equal to that of the third section 3123.

Back flow prevention units 3151 and 3152 may be disposed on the second guide rail 312 in order to prevent the second protrusion 232 from moving in a circular motion in a reverse direction, thereby allowing the second protrusion 232 to move in a circular motion in one direction. For example, the back flow prevention units 3151 and 3152 may be disposed on the second and fourth sections 3122 and 3124, respectively.

For example, when the second protrusion 232 counterclockwise presses the back flow prevention units 3151 and 3152, the back flow prevention units 3151 and 3152 may be lowered and thus permit the second protrusion 232 to pass. However, when the second protrusion 232 clockwise presses the back flow prevention units 3151 and 3152, the back flow prevention units 3151 and 3152 may not be lowered and thus may restrict movement of the second protrusion 232.

Figure 6A:
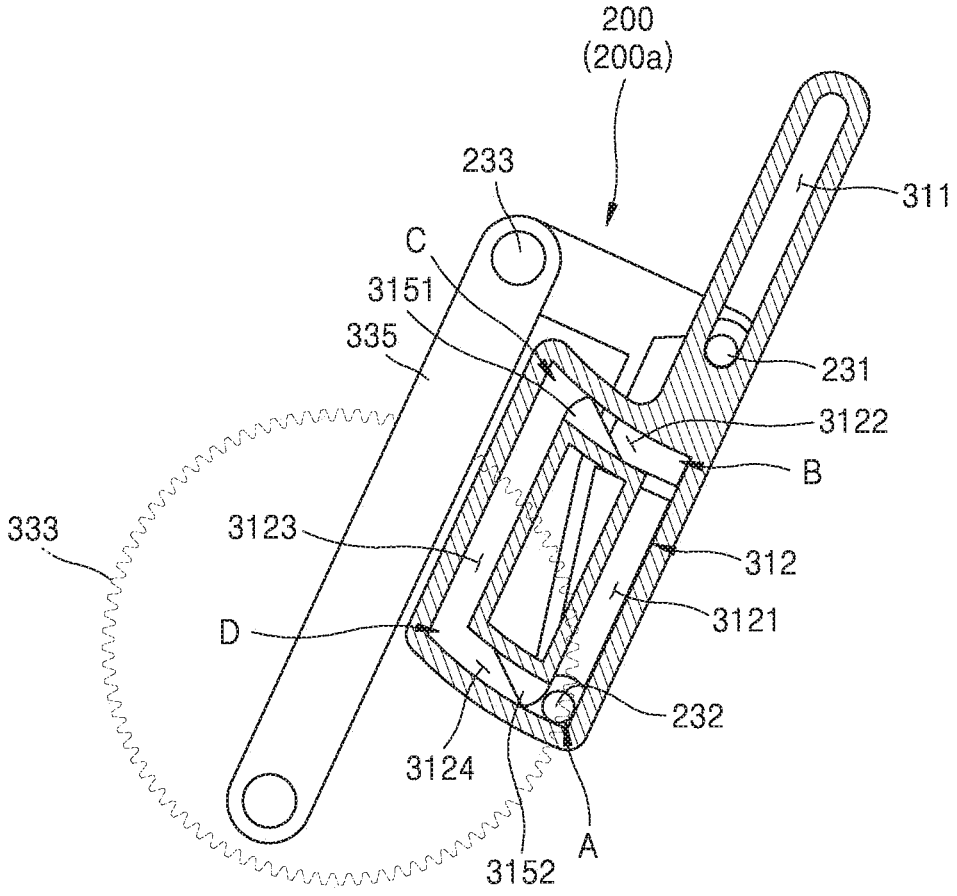
FIGS. 6A-6E are cross-sectional views for explaining an operation of the print medium loading device of FIG. 4 according to an example.

Referring to FIGS. 3A, 3B, and 6A, the first protrusion 231 of the moving gate 200 is located on one end of the first guide rail 311, and the second protrusion 232 thereof is located at the point A of the second guide rail 312. At this time, the moving gate 200 is positioned at the first location 200*a*.

Figure 6B:
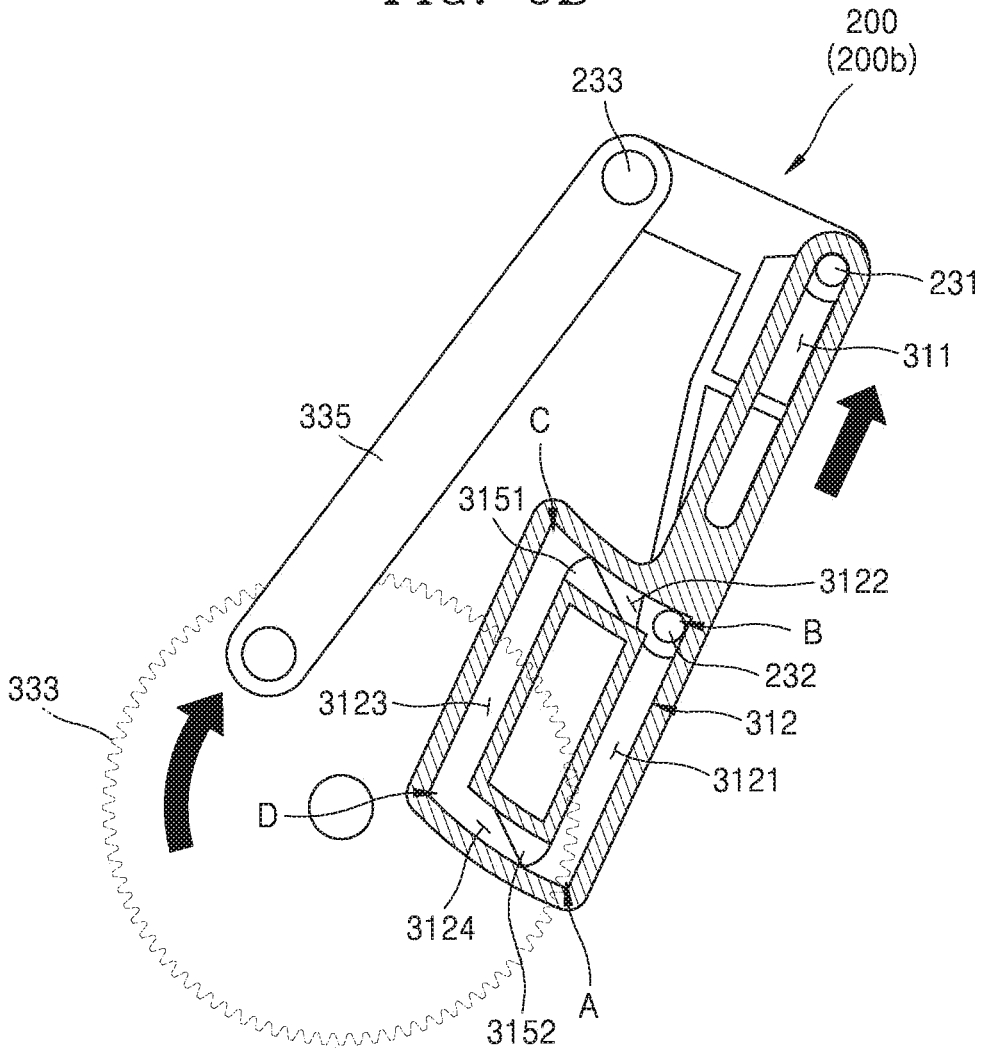

Referring to FIGS. 3C and 6B, as the crank wheel 333 rotates, the connection link 335 connected to the crank wheel 333 moves, and a driving force is transmitted to the moving gate 200 connected to the crank wheel 333.

As the driving force is transmitted to the moving gate 200, the first protrusion 231 of the moving gate 200 moves up to the other end of the first guide rail 311 along the first guide rail 311, and the second protrusion 232 thereof moves to the point B along the first section 3121. Accordingly, the moving gate 200 moves from the first location 200*a* to the second location 200*b*.

Figure 6C:
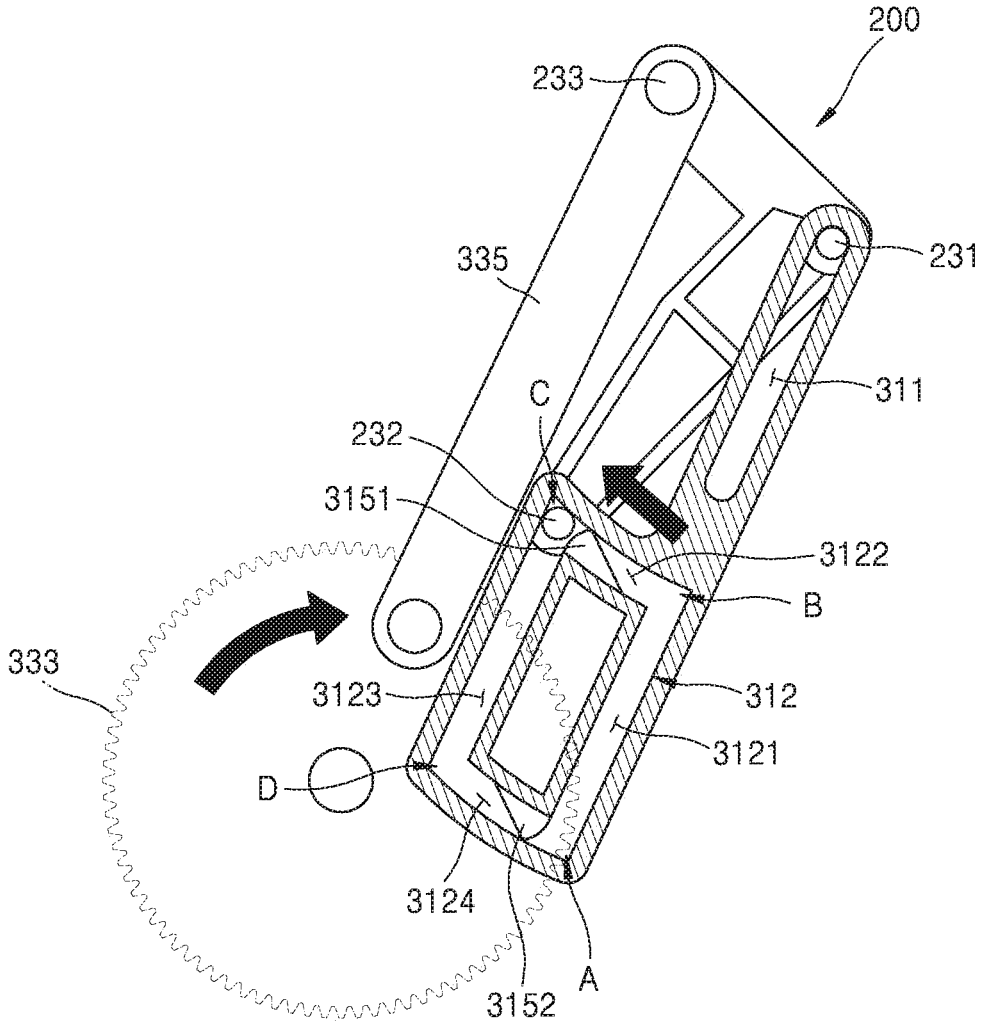

Referring to FIGS. 3D and 6C, as the crank wheel 333 additionally rotates, a driving force is transmitted to the moving gate 200. At this time, because the first protrusion 231 of the moving gate 200 has reached the other end of the first guide rail 311, movement of the first protrusion 231 is restricted, and the second protrusion 232 of the moving gate 200 moves to the point C along the second section 3122. Accordingly, the leading end of the moving gate 200 pivots.

While the second protrusion 232 is moving along the second section 3122, the back flow prevention unit 3151 is pressed by the second protrusion 232 and thus a height of the back flow prevention unit 3151 is lowered, which allows the back flow prevention unit 3151 to pass the moving gate 200. The back flow prevention unit 3151 blocks movement of the second protrusion 232 back to the point B along the second section 3122.

Figure 6D:
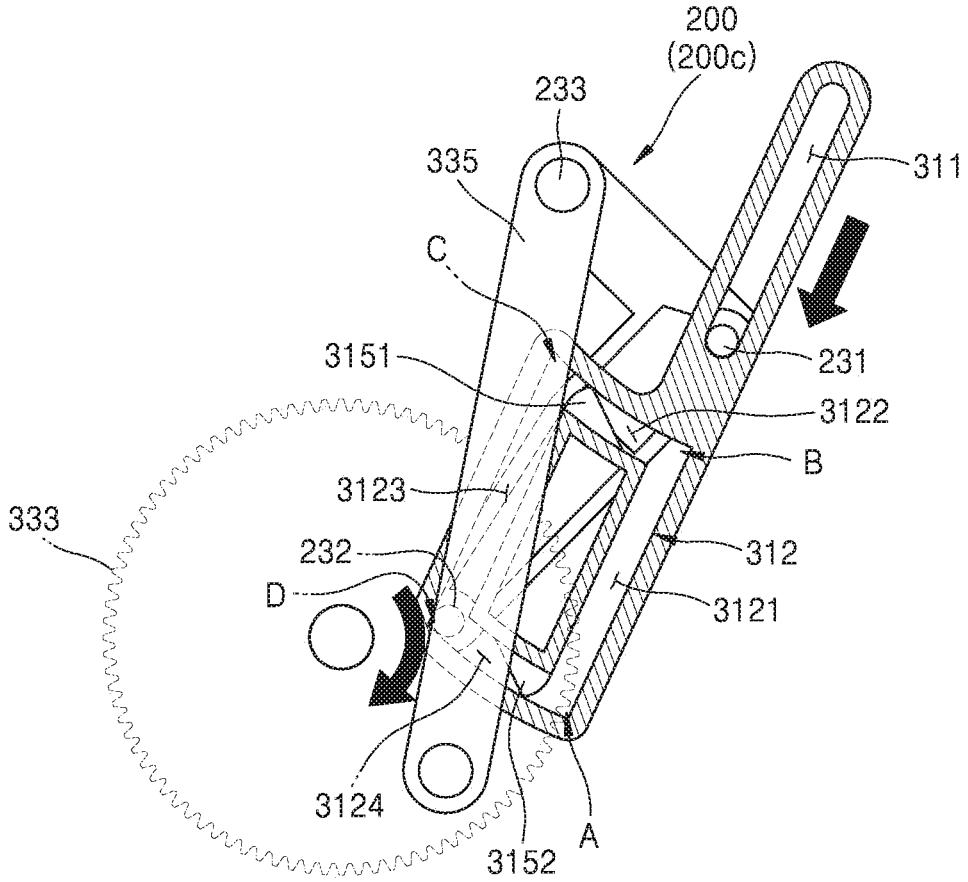

Referring to FIGS. 3E and 6D, as the crank wheel 333 additionally rotates, the connection link 335 moves, and a driving force is transmitted to the moving gate 200. Accordingly, the first protrusion 231 of the moving gate 200 moves back to the one end of the first guide rail 311 along the first guide rail 311, and the second protrusion 232 thereof moves to the point D along the third section 3123. Accordingly, the moving gate 200 is moved to the third location 200*c*.

Figure 6E:
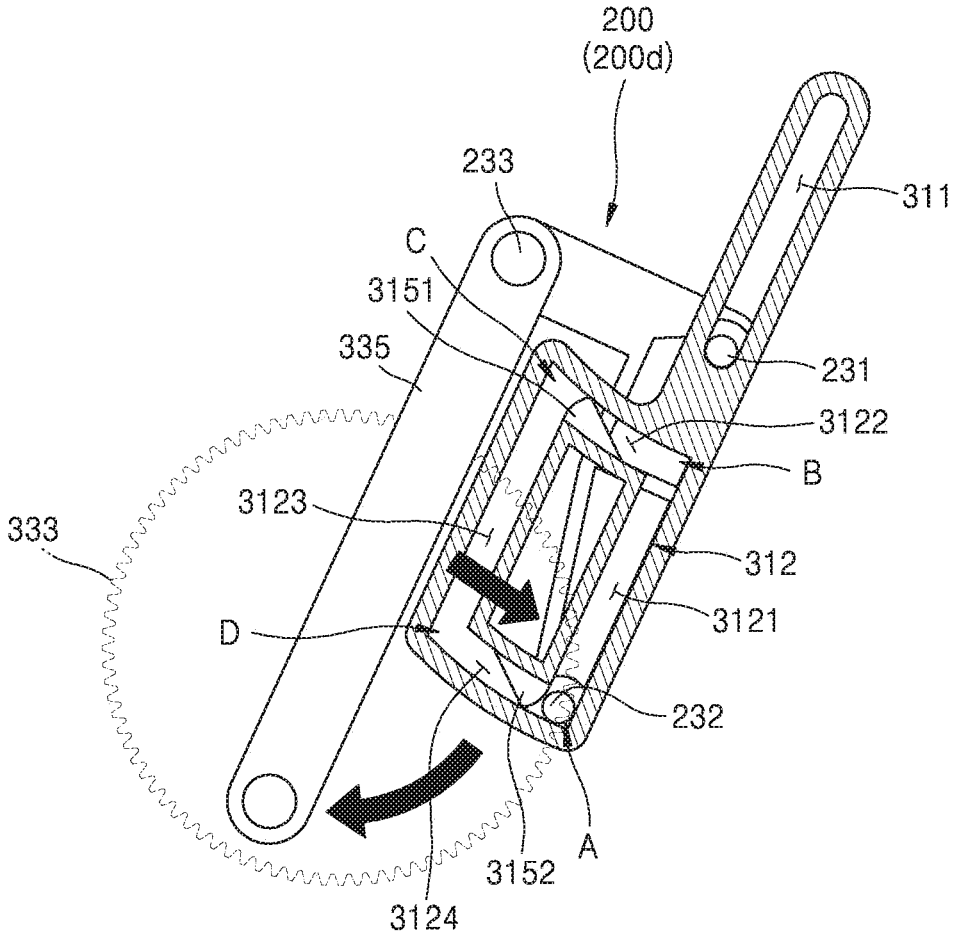

Referring to FIGS. 3F, 3G, and 6E, as the crank wheel 333 additionally rotates when the first protrusion 231 of the moving gate 200 has reached the one end of the first protrusion 231, movement of the first protrusion 231 is restricted, and the second protrusion 232 of the moving gate 200 moves to the point A along the fourth section 3124. During this process, the moving gate 200 is moved from the third location 200*c* to the fourth location 200*d*.

While the second protrusion 232 is moving along the fourth section 3124, the back flow prevention unit 3152 is pressed by the second protrusion 232 and thus a height of the back flow prevention unit 3152 is lowered, which allows the back flow prevention unit 3152 to pass the moving gate 200. The back flow prevention unit 3152 blocks movement of the second protrusion 232 back to the point C along the fourth section 3124.

Figure 7:
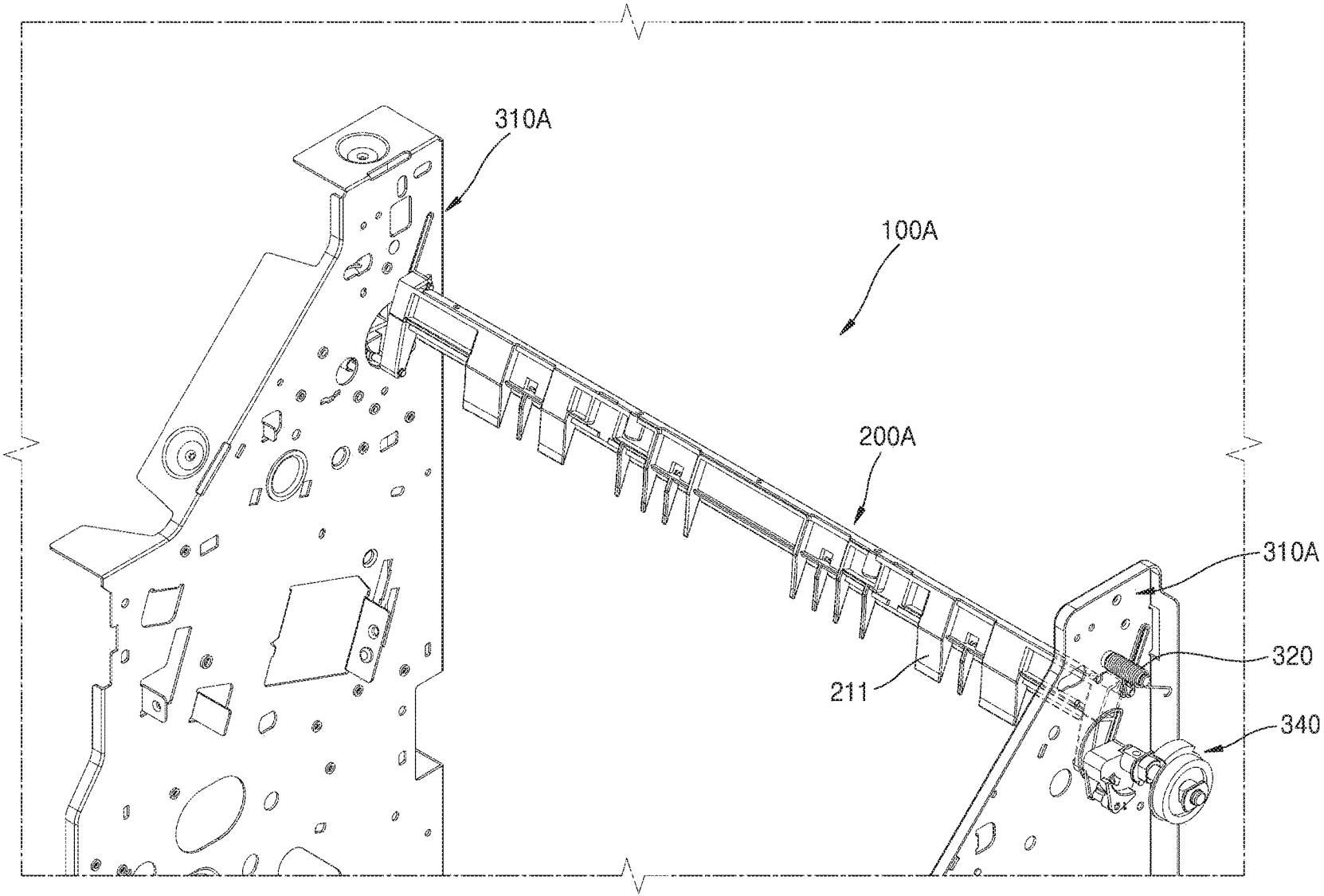
FIG. 7 is a perspective view for explaining a print medium loading device according to an example.
Figure 8A:
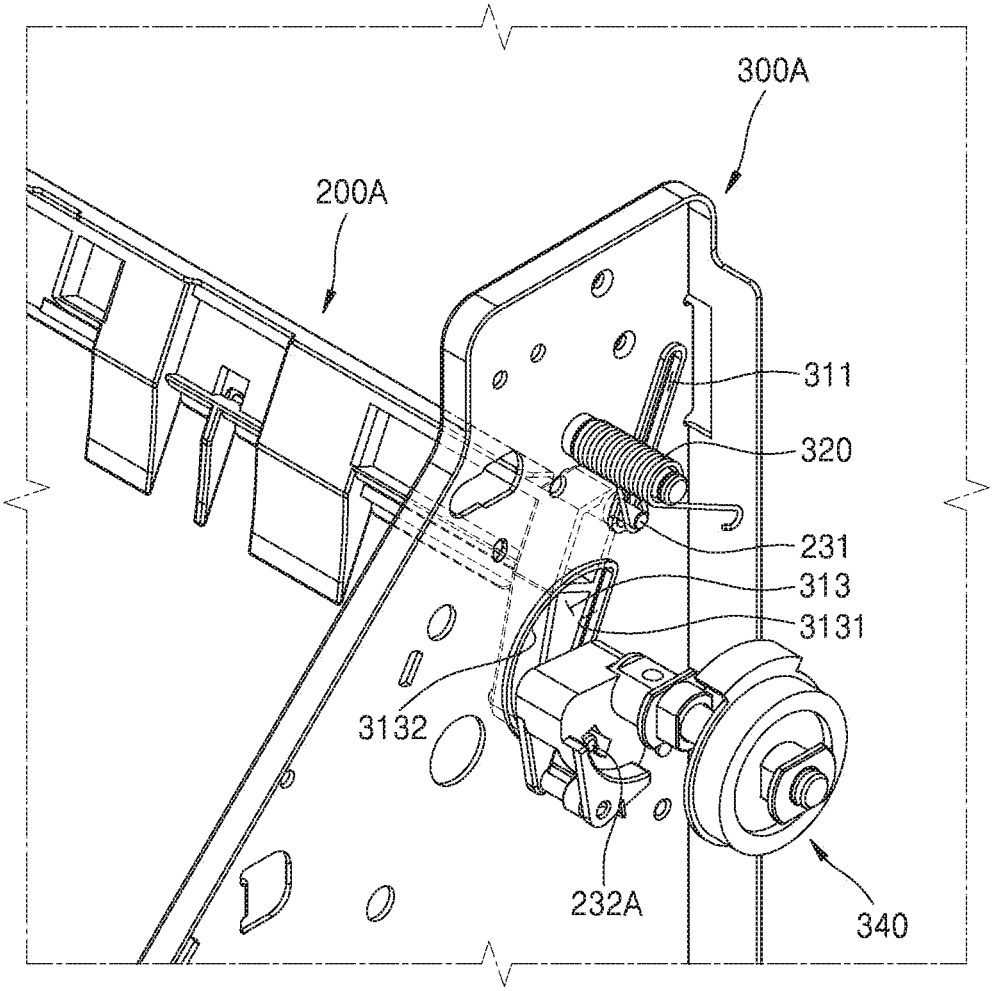
FIGS. 8A and 8B are magnified perspective views of a portion of the print medium loading device of FIG. 7 viewed at different angles according to an example.
Figure 8B:
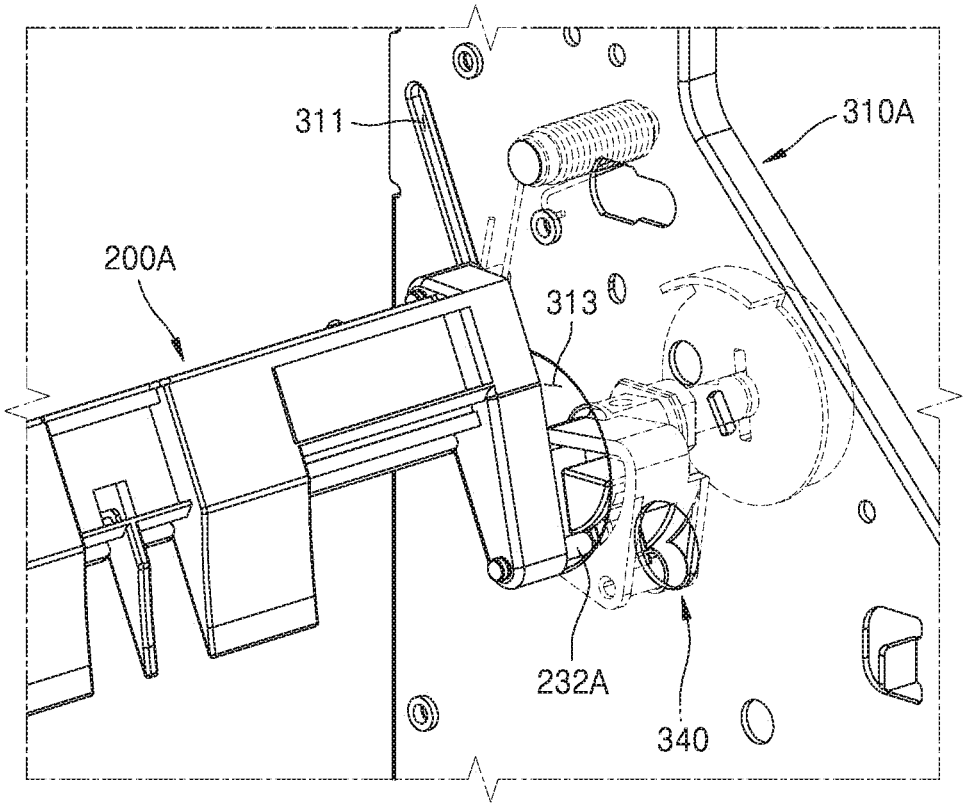

FIG. 7 is a perspective view for explaining a print medium loading device according to an example. FIGS. 8A and 8B are magnified perspective views of a portion of the print medium loading device of FIG. 7 viewed at different angles according to an example. For convenience of explanation, FIGS. 7, 8A, and 8B omit illustration of the transporting roller unit 110 and the loading unit 130.

Referring to FIGS. 7, 8A, and 8B, a print medium loading device 100A includes a guide structure 310A disposed on either end of a moving gate 200A to guide movement of the moving gate 200A such that the moving gate 200A sequentially has the first location 200*a*, the second location 200*b*, the third location 200*c*, and the fourth location 200*d*, an elastic member 320 providing an elastic force to the moving gate 200A such that the moving gate 200A moves from the first location 200*a* to the second location 200*b*, and a power transmit unit 340 providing a driving force such that the moving gate 200A moves from the second location 200*b* to the fourth location 200*d* via the third location 200*c*.

Each of the guide structures 310A includes the first guide rail 311 which guides the reciprocating motion of the first protrusion 231, and a guide hole 313 which guides a circular motion of a second protrusion 232A. The second protrusion 232A may move in one direction in accordance with a shape of the guide hole 313.

The first guide rail 311 may extend in a straight line. As described above, the width of the first guide rail 311 may correspond to a dimension (e.g., a height or a diameter) of the first protrusion 231.

The shape of the guide hole 313 may be defined by a straight portion 3131 and a curved portion 3132. For example, the shape of the guide hole 313 may be semicircular. However, the shape of the guide hole 313 is not limited thereto, and the guide hole 313 may have any of various shapes as long as it includes the straight portion 3131 and the curved portion 3132. A width of the guide hole 313 is greater than a dimension (e.g., a height or a diameter) of the second protrusion 232A.

One end of the elastic member 320 is connected to the first protrusion 231, and the elastic member 320 provides an elastic force to the first protrusion 231 in a certain direction of the guide rail 311. For example, the elastic member 320 may provide an elastic force in such a direction that the moving gate 200A is kept away from the first print medium P1 and the second print medium P2. The elastic member 320 may provide an elastic force such that the first protrusion 231 moves toward the other end of the first guide rail 311.

The power transmit unit 340 may be configured to transmit a driving force to the second protrusion 232A that has passed through the guide hole 313.

Figure 9A:
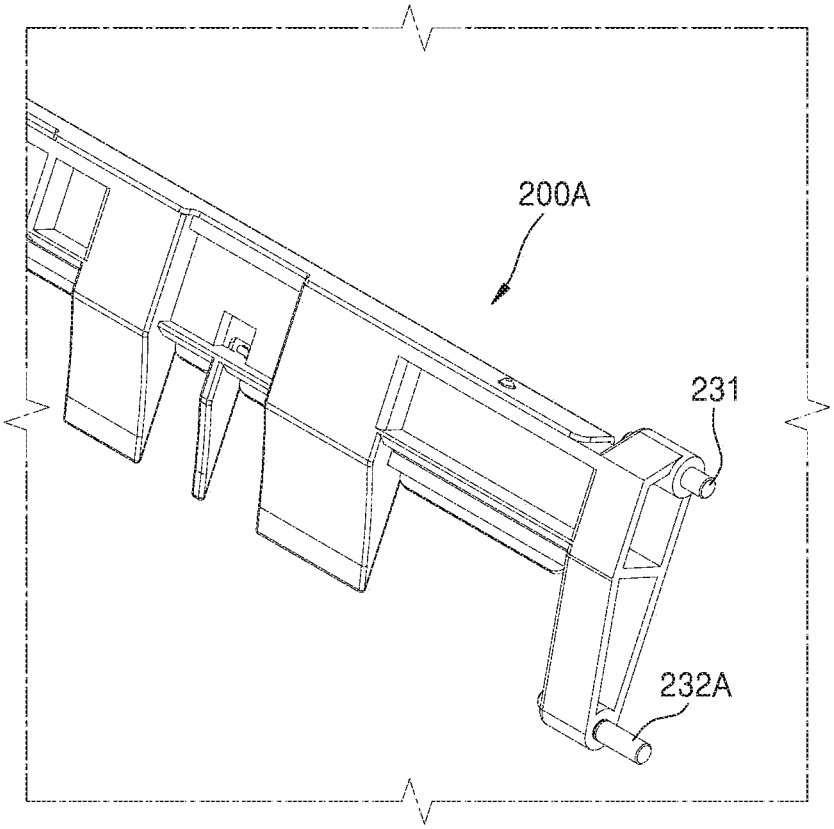
FIG. 9A is a perspective view of one end of the moving gate of FIG. 7 according to an example.
Figure 9B:
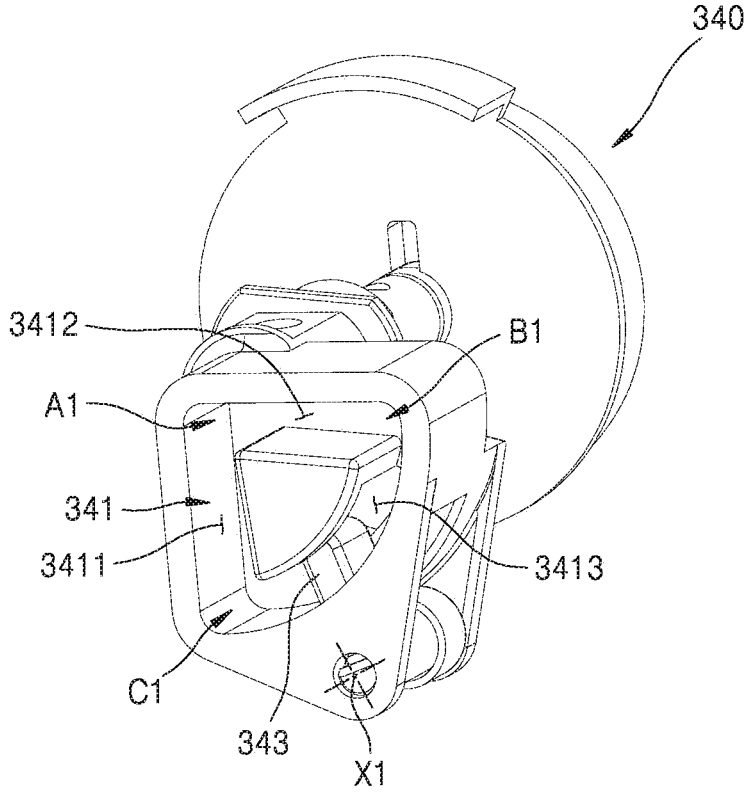
FIG. 9B is a perspective view of the power transmit unit of FIG. 7 according to an example.
Figure 9C:
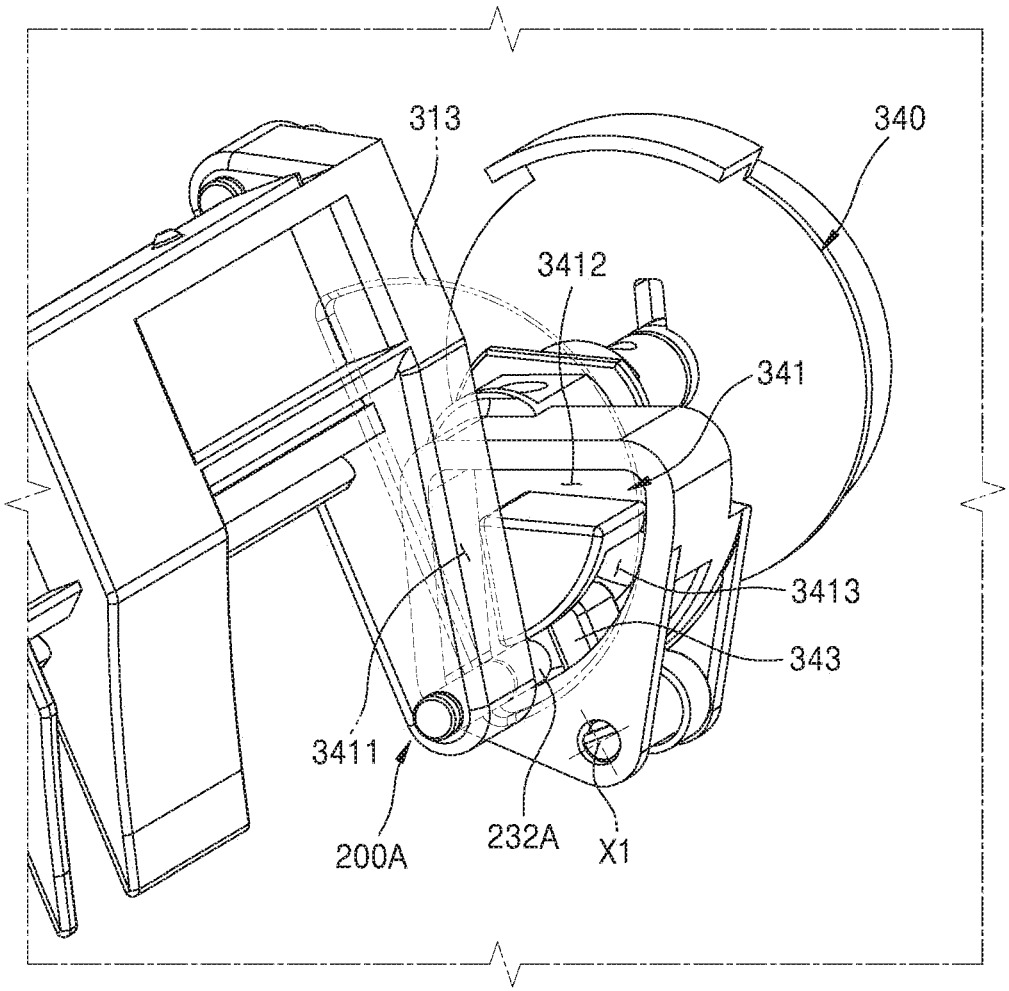
FIG. 9C is a perspective view of the power transmit unit connected to the one end of the moving gate according to an example.

FIG. 9A is a perspective view of one end of the moving gate of FIG. 7 according to an example, FIG. 9B is a perspective view of the power transmit unit of FIG. 7 according to an example, and FIG. 9C is a perspective view of the power transmit unit connected to one end of the moving gate according to an example.

Referring to FIG. 9A, the first protrusion 231 and the second protrusion 232A of the moving gate 200A are spaced apart from each other. A height of the second protrusion 232A is greater than that of the first protrusion 231.

Referring to FIGS. 9B and 9C, the power transmit unit 340 includes a third guide rail 341 into which the second protrusion 232A is inserted, and a pressurization structure 343 selectively pressing the second protrusion 232A inserted into the third guide rail 341.

The third guide rail 341 includes a first straight section 3411, a second straight section 3412 that extends from one end of the first straight section 3411 in a direction intersecting with an extension direction of the first straight section 3411, and a curved section 3413 connecting the first straight section 3411 to the second straight section 3412. The first straight section 3411 and the second straight section 3412 are connected to each other at a point A1, the second straight section 3412 and the curved section 3413 are connected to each other at a point B1, and the curved section 3413 and the first straight section 3411 are connected to each other at a point C1.

The third guide rail 341 may have a fan shape. A width of each of the first straight section 3411, the second straight section 3412, and the curved section 3123 may correspond to a dimension (e.g., a height or a diameter) of the second protrusion 232A.

The pressurization structure 343 is pivotable about a pivoting shaft X1 and receives an elastic force to pivot in one direction. When the second protrusion 232A is in the curved section 3413, the pressurization structure 343 may contact the second protrusion 232A and provide a driving force to the second protrusion 232A.

FIGS. 10A-10D are cross-sectional views for explaining a relationship among a second protrusion, a guide hole, and a power transmit unit, according to an example. FIGS. 11A-11E are cross-sectional views for explaining movements of a moving gate, according to an example.

Figure 10A:
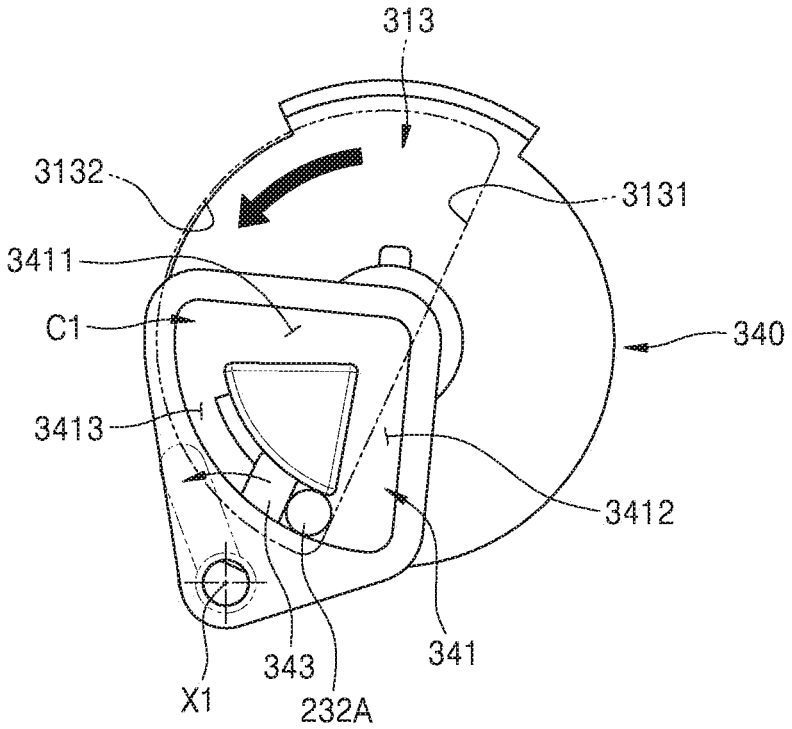
FIGS. 10A-10D are cross-sectional views for explaining a relationship among a second protrusion, a guide hole, and a power transmit unit, according to an example.
Figure 11A:
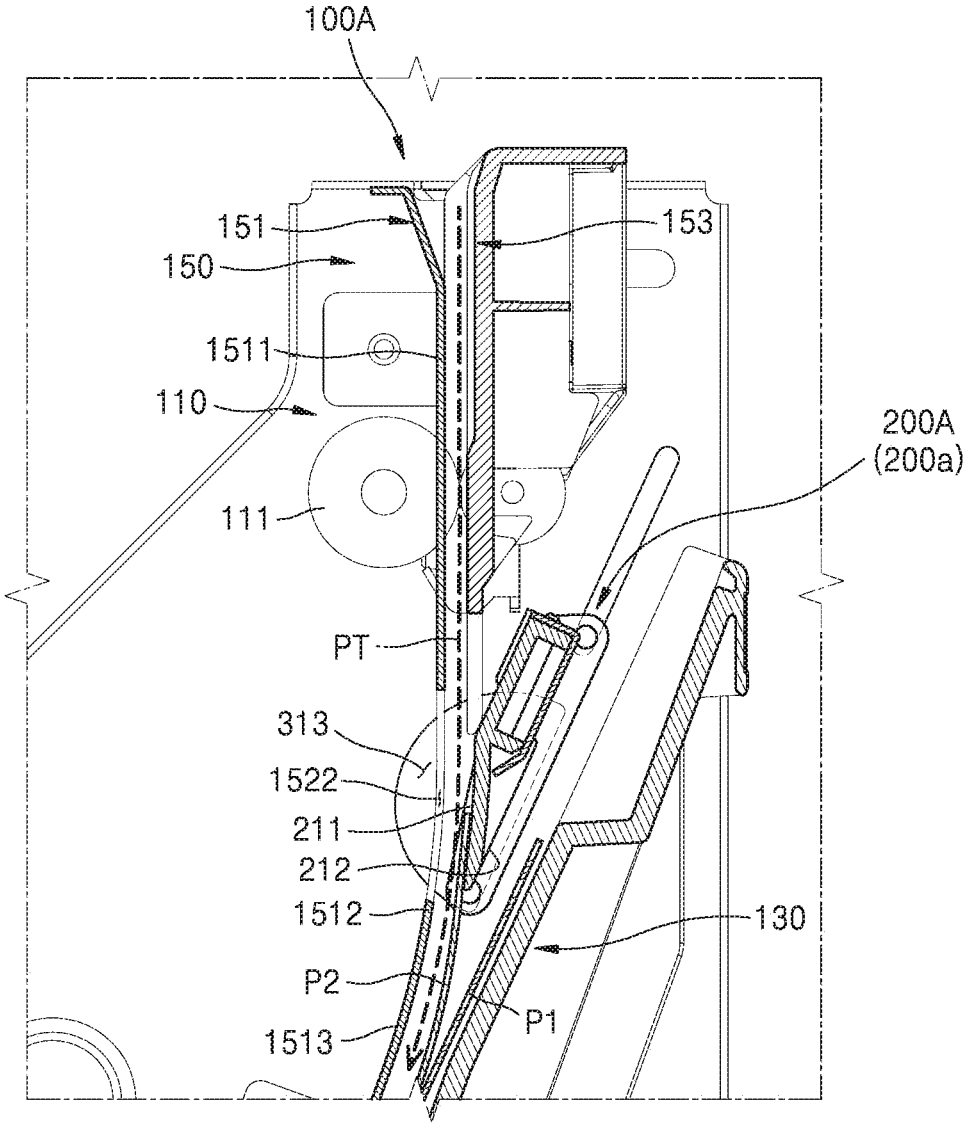
FIGS. 11A-11E are cross-sectional views for explaining movements of a moving gate, according to an example.

Referring to FIGS. 10A and 11A, the second protrusion 232A is inserted into the curved section 3413 of the third guide rail 341 via the guide hole 313. The pressurization structure 343 contacts the second protrusion 232A and presses the second protrusion 232A with a received elastic force. In this state, the power transmit unit 340 rotates counterclockwise.

However, because movement of the second protrusion 232A is restricted by the straight portion 3131 of the guide hole 313, the second protrusion 232A may not move even when the power transmit unit 340 rotates. Thus, due to the rotation of the power transmit unit 340, the pressurization structure 343 pivots counterclockwise, which is reverse to a direction in which the elastic force is applied. At this time, the moving gate 200A is positioned at the first location 200*a*.

Figure 10B:
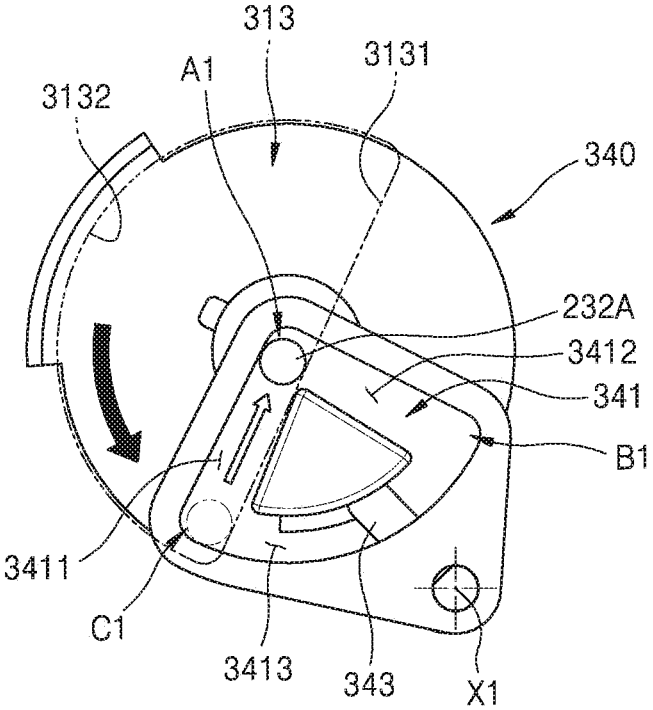
Figure 11B:
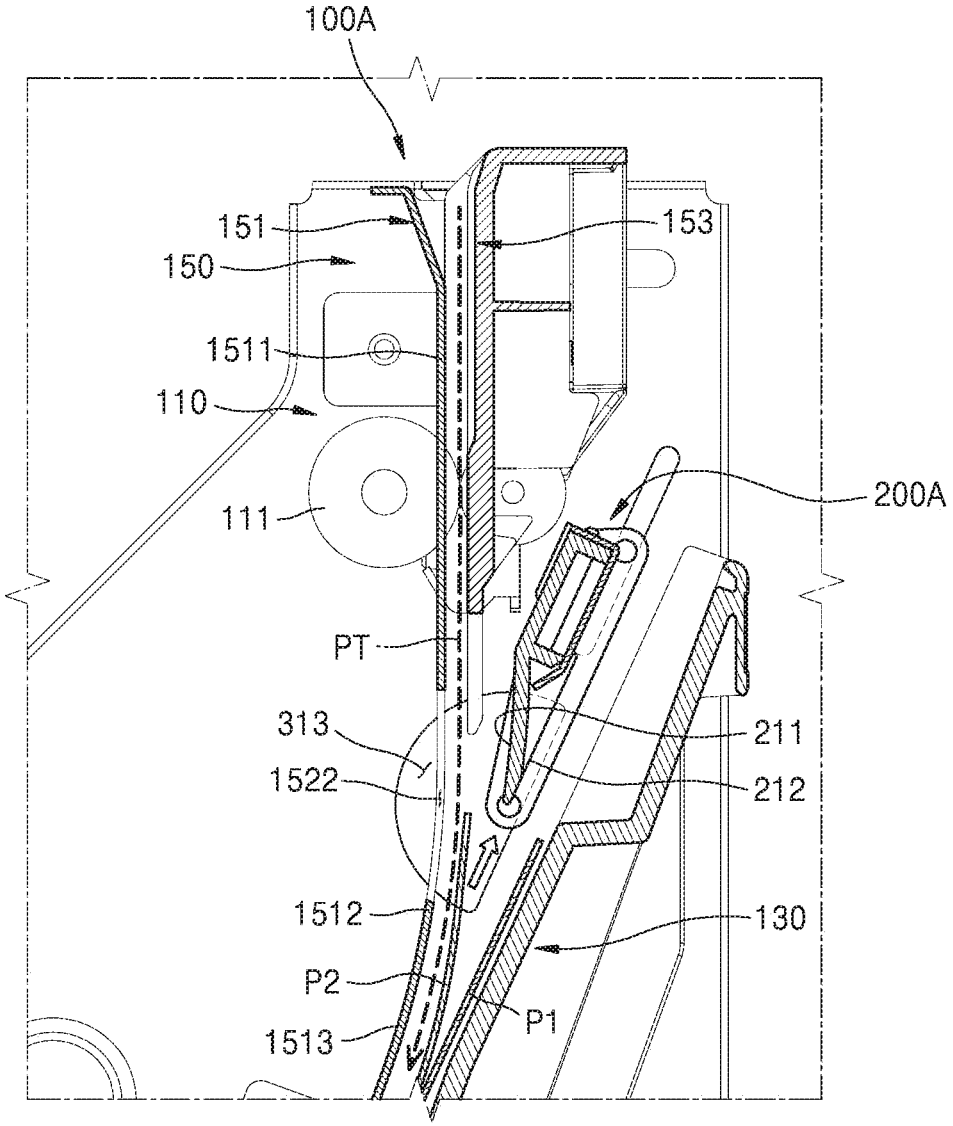

Referring to FIGS. 10B and 11B, as the power transmit unit 340 additionally rotates while the second protrusion 232A is restricted by the straight portion 3131 of the guide hole 313, the curved section 3413 rotates, and the second protrusion 232A is located at the point C1.

Because the moving gate 200A is receiving the elastic force from the elastic member 320, the second protrusion 232A moves from the point C1 to the point A1 along the first straight section 3411.

Figure 10C:
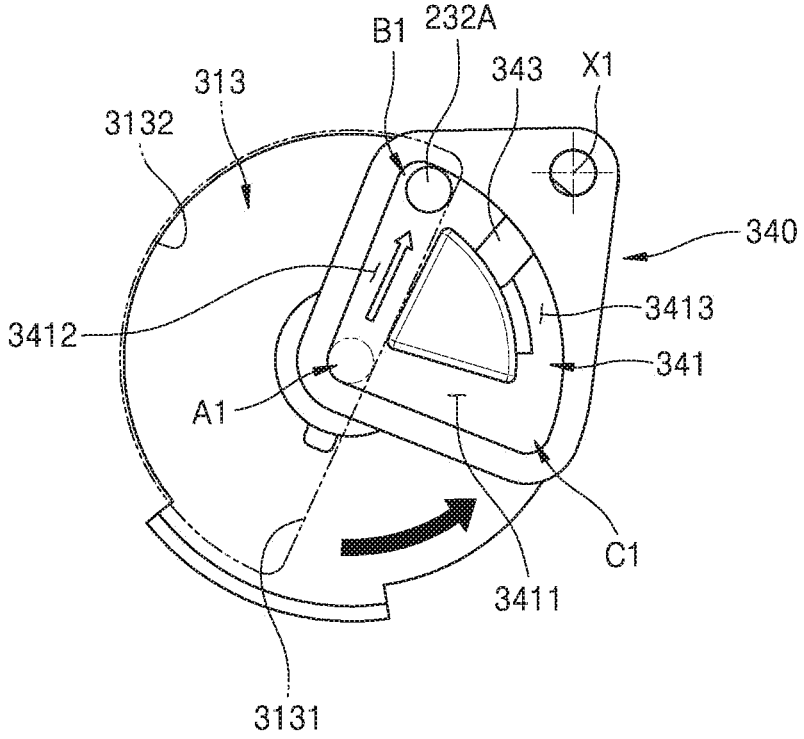
Figure 11C:
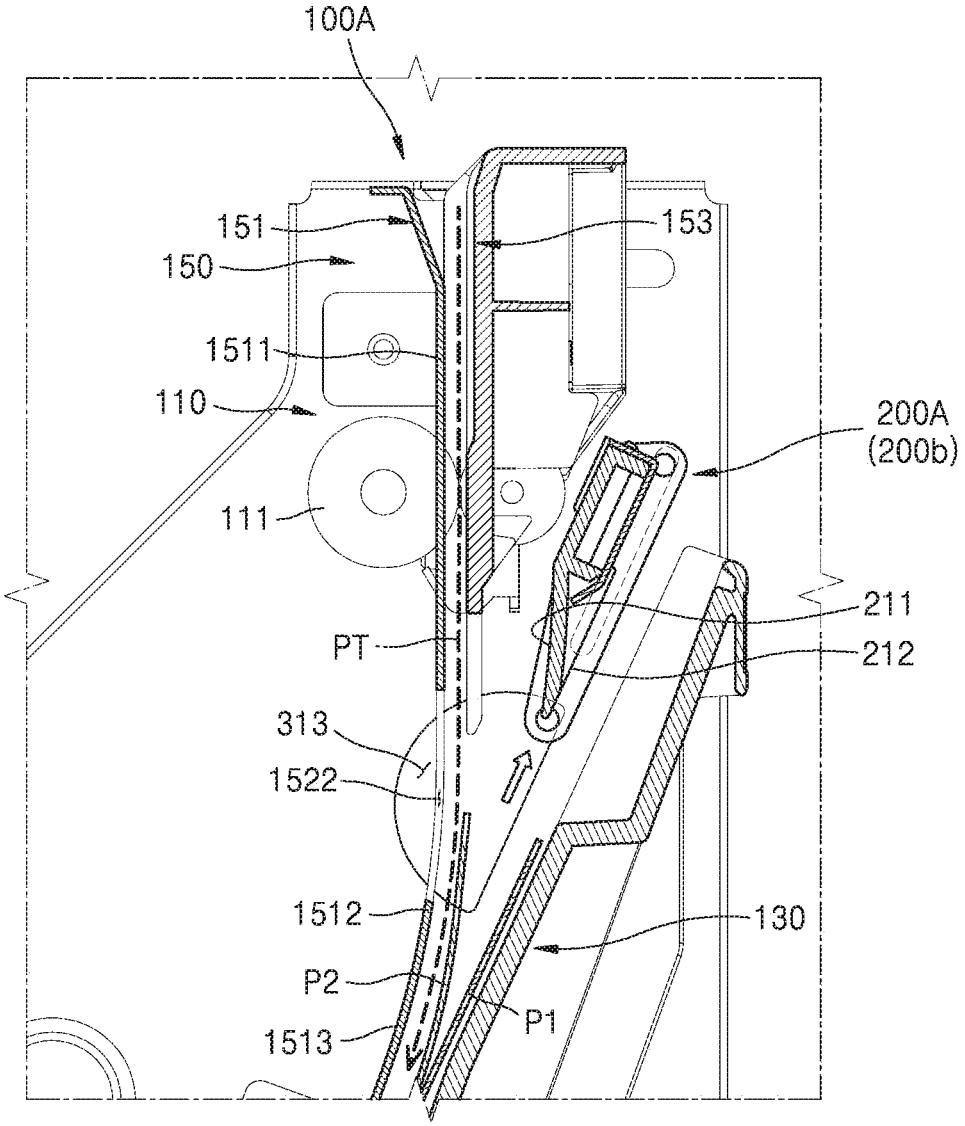

Referring to FIGS. 10C and 11C, as the power transmit unit 340 additionally rotates, the second straight section 3412 may be aligned with the straight portion 3131 of the guide hole 313 in the same direction. In this case, because the moving gate 200A is receiving the elastic force from the elastic member 320, the second protrusion 232A is moved from the point A1 to the point B1 along the second straight section 3412. Accordingly, the moving gate 200A is positioned at the second location 200*b*.

Figure 10D:
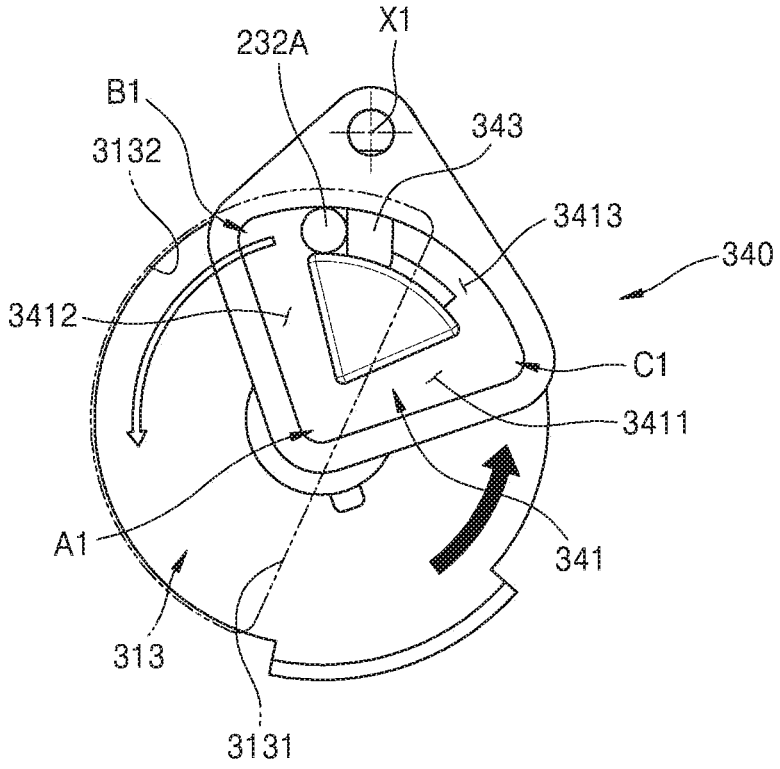
Figure 11D:
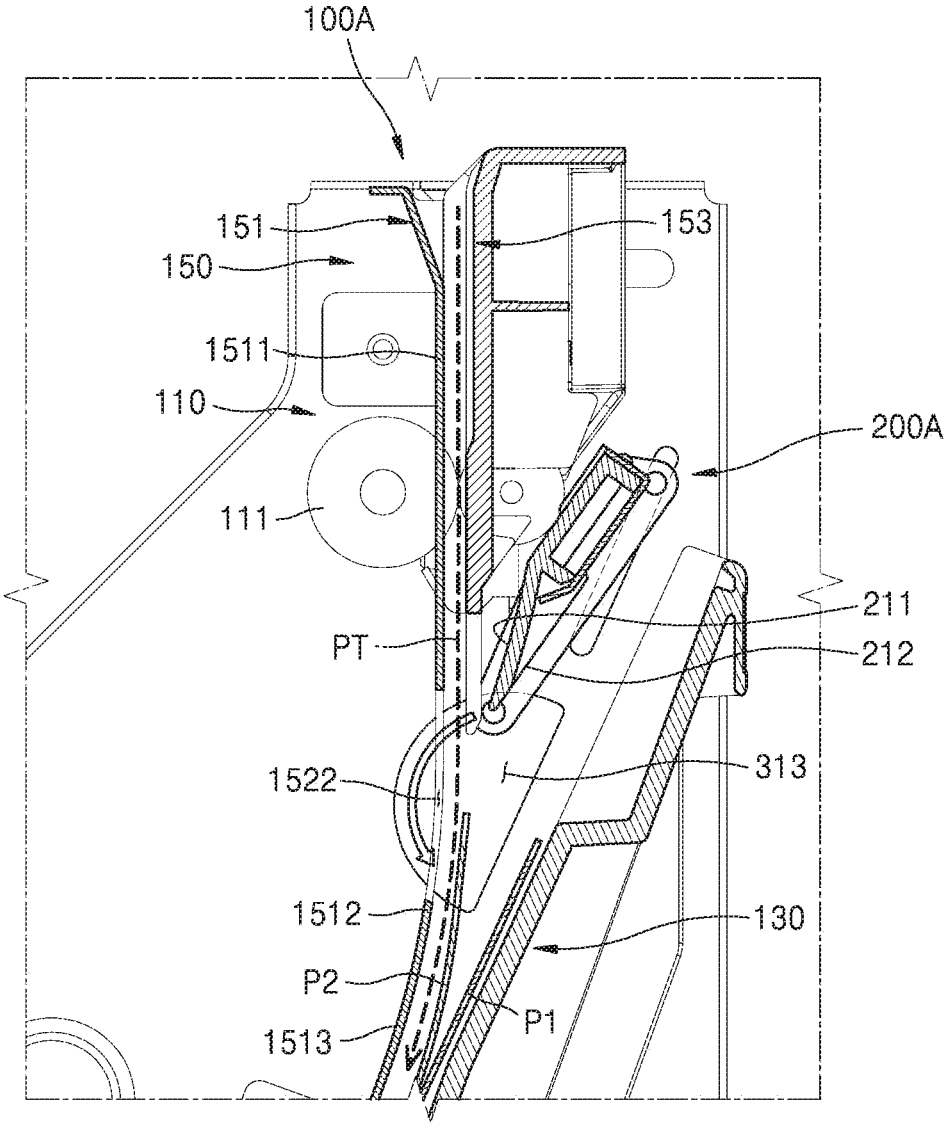

Referring to FIGS. 10D and 11D, as the power transmit unit 340 additionally rotates, the second protrusion 232A located in the curved section 3413 is pressed by the pressurization structure 343. Because the pressurization structure 343 receives an elastic force in a direction closer to the second protrusion 232A, the second protrusion 232A is pressed by the pressurization structure 343 rotating with the rotation of the power transmit unit 340, in the rotating direction of the pressurization structure 343. Thus, the second protrusion 232A moves along the curved portion 3132 of the guide hole 313.

While the first protrusion 231 is moving along the first guide rail 311 and the second protrusion 232A is moving along a curve of the guide hole 313, the moving gate 200A is positioned over the transport path PT of the second print medium P2 and is moved to the fourth location 200*d* where the moving gate 200A overlaps the trailing end of the second print medium P2 loaded on the loading unit 130, via the third location 200*c* where the moving gate 200A overlaps the trailing end of the second print medium P2.

Figure 11E:
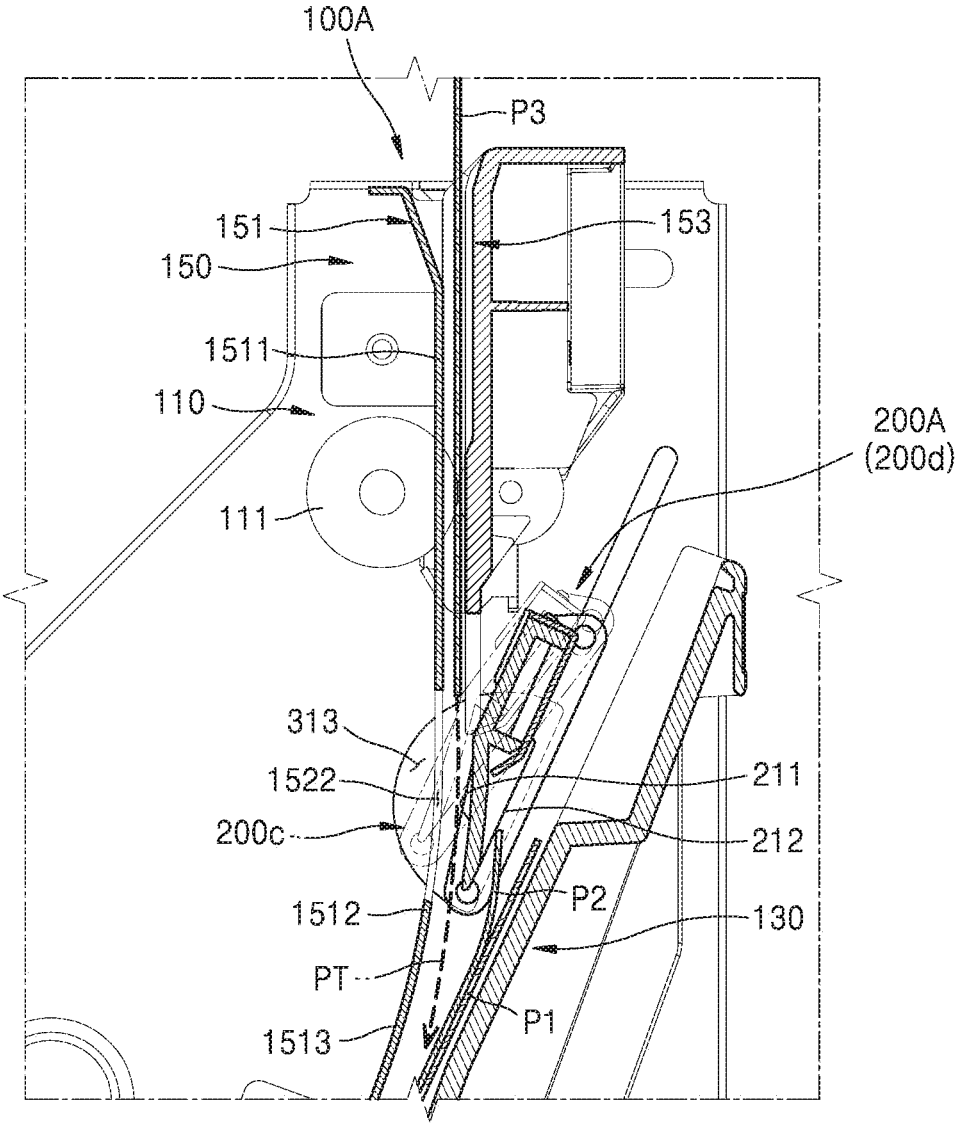

Referring to FIG. 11E, while the moving gate 200 is moving from the third location 200*c* to the fourth location 200*d*, the moving gate 200 presses the trailing end of the second print medium P2 loaded on the loading unit 130 in a direction closer to the loading unit 130.

A print medium finishing apparatus, an image forming system, and a print medium loading device used in the image forming system, according to an example, may prevent a paper alignment error by using a simple structure.

A print medium finishing apparatus, an image forming system, and a print medium loading device used in the image forming system, according to an example, may prevent disorder or damage of loaded print media by minimizing contact with the loaded print media.

While one or more examples have shown and described with reference to the figures, it will be understood by those of ordinary skill in the art that various changes in form and details may be made therein without departing from the spirit and scope of the inventive concept as defined by the following claims.

What is claimed is:

1. A print medium loading device comprising:

a loading unit on which a print medium is loadable;

a transporting roller unit to transport a print medium toward the loading unit;

a moving gate between the loading unit and the transporting roller unit, the moving gate movable between a first location, a second location, a third location, and a fourth location; and a print medium guide comprising an opening into which a leading end of the moving gate is insertable, wherein, when a first print medium is loaded on the loading unit and the transporting roller unit transports a second print medium toward the loading unit, the moving gate is positioned at the first location to overlap a trailing end of the first print medium toward the moving gate; and when a leading end of the second print medium is past the moving gate and the second print medium is loaded on the loading unit, the moving gate sequentially moves:

from the first location to the second location away from the first print medium and the second print medium, from the second location to the third location to be positioned over a transport path of the second print medium and to overlap a trailing end of the second printing medium opposite to the leading end of the second print medium loaded on the loading unit, and from the third location to the fourth location, to move toward the trailing end of the second print medium loaded to the loading unit, and wherein, when the moving gate moves from the second location to the third location, the leading end of the moving gate is inserted into the opening.

2. The print medium loading device of claim 1, wherein, when the moving gate moves from the third location to the fourth location, the moving gate is to press the trailing end of the second print medium loaded on the loading unit in a direction toward the loading unit.

3. The print medium loading device of claim 1, wherein, when the moving gate is positioned at the first location, the moving gate is to be spaced apart from the loading unit.

4. The print medium loading device of claim 3, wherein, when the moving gate is moving from the first location to the second location, a gap between the moving gate and the loading unit is to be maintained to be constant or to increase.

5. The print medium loading device of claim 1, wherein, when the moving gate moves from the second location to the third location, a leading end of the moving gate toward the loading unit moves toward the transport path of the second print medium.

6. The print medium loading device of claim 2, wherein the transporting roller unit is to transport a third print medium, and wherein, when the moving gate is positioned at the fourth location, the moving gate overlaps the trailing ends of the first and second print media and blocks contact between a leading end of the third print medium toward the loading unit and the trailing ends of the first and second print media.

7. The print medium loading device of claim 2, wherein the moving gate comprises a first protrusion and a second protrusion on an end of the moving gate in a direction perpendicular to a moving direction of the moving gate, the first protrusion and the second protrusion being spaced apart from each other, and wherein the print medium loading device further comprises:

a guide structure to guide movements of the first protrusion and the second protrusion such that the moving gate sequentially moves to the first location, the second location, the third location, and the fourth location; and a power transmit unit to transmit a driving force to cause the moving gate to move.

8. The print medium loading device of claim 7, wherein the guide structure comprises a first guide rail to guide a reciprocating motion of the first protrusion, and a second guide rail to guide a circular motion of the second protrusion.

9. The print medium loading device of claim 8, wherein the power transmit unit comprises:

a crank wheel that is rotatable; and a connection link to connect the crank wheel to the moving gate, wherein the connection link transfers a rotating motion of the crank wheel to the reciprocating motion of the first protrusion.

10. The print medium loading device of claim 8, wherein the second guide rail comprises a back flow prevention unit to block movement of the second protrusion in a reverse direction such that the second protrusion moves in the circular motion in one direction.

11. The print medium loading device of claim 7, wherein the guide structure comprises a first guide rail to guide a reciprocating motion of the first protrusion, and a guide hole into which the second protrusion is insertable and which guides a circular motion of the second protrusion.

12. The print medium loading device of claim 11, further comprising an elastic member connected to the moving gate, the elastic member to provide an elastic force to the moving gate such that the moving gate moves from the first location to the second location.

13. The print medium loading device of claim 12, wherein the power transmit unit transmits the driving force to the second protrusion having passed through the guide hole, the power transmit unit comprising:

a third guide rail into which the second protrusion is inserted and along which the second protrusion moves in a circular motion; and a pressurization structure to press the second protrusion inserted into the third guide rail.

14. A print medium loading device comprising:

a loading unit on which a print medium is loadable;

a transporting roller unit to transport the print medium toward the loading unit a moving gate, located between the loading unit and the transporting roller unit and movable between a first location, a second location, a third location, and a fourth location, the moving gate comprising a first protrusion and a second protrusion on an end of the moving gate in a direction perpendicular to a moving direction of the moving gate, the first protrusion and the second protrusion being spaced apart from each other;

a guide structure to guide a movement of the first protrusion and the second protrusion such that the moving gate sequentially moves to the first location, the second location, the third location, and the fourth location; and a power transmit unit to transmit a driving force to cause the moving gate to move wherein the moving gate is to:

block a contact between a trailing end of a first print medium loaded onto the loading unit and a leading end of a second print medium trailing the first print medium when the second print medium is transported by the transporting roller unit toward the loading unit, and press a trailing end of the second print medium loaded on the loading unit in a direction toward the loading unit when the second print medium is loaded on the loading unit, and wherein the guide structure comprises:

a first guide rail to guide a reciprocating motion of the first protrusion; and a second guide rail to guide a circular motion of the second protrusion.

15. The print medium loading device of claim 14, wherein the power transmit unit comprises:

a rotatable crank wheel; and a connection link to connect the crank wheel to the moving gate, wherein the connection link transfers a rotating motion of the crank wheel to the reciprocating motion of the first protrusion.

16. The print medium loading device of claim 14, wherein the second guide rail comprises a back flow prevention unit to block movement of the second protrusion in a reverse direction such that the second protrusion moves in the circular motion in one direction.

17. A print medium loading device comprising:

a loading unit on which a print medium is loadable;

a transporting roller unit to transport the print medium toward the loading unit a moving gate, located between the loading unit and the transporting roller unit and movable between a first location, a second location, a third location, and a fourth location, the moving gate comprising a first protrusion and a second protrusion on an end of the moving gate in a direction perpendicular to a moving direction of the moving gate, the first protrusion and the second protrusion being spaced apart from each other;

a guide structure to guide a movement of the first protrusion and the second protrusion such that the moving gate sequentially moves to the first location, the second location, the third location, and the fourth location; and a power transmit unit to transmit a driving force to cause the moving gate to move, wherein the moving gate is to:

block a contact between a trailing end of a first print medium loaded onto the loading unit and a leading end of a second print medium trailing the first print medium when the second print medium is transported by the transporting roller unit toward the loading unit, and press a trailing end of the second print medium loaded on the loading unit in a direction toward the loading unit when the second print medium is loaded on the loading unit, and wherein the guide structure comprises:

a first guide rail to guide a reciprocating motion of the first protrusion; and a guide hole into which the second protrusion is insertable and which guides a circular motion of the second protrusion.

18. The print medium loading device of claim 17, further comprising an elastic member connected to the moving gate, the elastic member to provide an elastic force to the moving gate such that the moving gate moves from the first location to the second location.

* * * * *